US011320227B2

(12) United States Patent
Williams et al.

(10) Patent No.: US 11,320,227 B2
(45) Date of Patent: May 3, 2022

(54) FIREARM CLEANING TOOLS

(71) Applicant: Otis Products, Inc., Lyons Falls, NY (US)

(72) Inventors: Nicholas Williams, Naples, FL (US); Nathan Williams, Naples, FL (US); Matthew Gioia, Naples, FL (US)

(73) Assignee: Otis Products, Inc., Lyons Falls, NY (US)

( * ) Notice: Subject to any disclaimer, the term of this patent is extended or adjusted under 35 U.S.C. 154(b) by 0 days.

(21) Appl. No.: 16/877,724

(22) Filed: May 19, 2020

(65) Prior Publication Data

US 2020/0370854 A1 Nov. 26, 2020

Related U.S. Application Data

(60) Provisional application No. 62/850,031, filed on May 20, 2019.

(51) Int. Cl.
*F41A 29/02* (2006.01)

(52) U.S. Cl.
CPC ..... *F41A 29/02* (2013.01)

(58) Field of Classification Search
CPC ..... F41A 29/00; F41A 29/02
See application file for complete search history.

(56) References Cited

U.S. PATENT DOCUMENTS 799,125 A * 9/1905 Whinery ..... F41A 35/02 42/96
937,729 A * 10/1909 Upham ..... F41A 29/02 15/104.2
4,803,792 A * 2/1989 Brown, Jr. ..... F41A 29/02 15/104.05
5,732,498 A * 3/1998 Arreguin ..... F41A 17/44 42/70.02
5,815,975 A * 10/1998 Rambo ..... F41A 29/00 42/95
8,079,170 B2 * 12/2011 Loftin ..... F41A 29/00 42/95
8,079,190 B2 * 12/2011 Hilburn, Jr. ..... E04F 15/02005 52/394
8,250,800 B1 * 8/2012 Johnson ..... F41A 29/02 42/95
8,453,367 B2 * 6/2013 Overstreet ..... F41A 3/64 42/108
9,810,499 B1 * 11/2017 Silver ..... F41A 17/44
10,279,381 B1 * 5/2019 Denison ..... B08B 9/00
10,746,494 B2 * 8/2020 Crawford ..... F41A 29/02
2019/0219354 A1 * 7/2019 Sprinkel ..... F41A 29/02

* cited by examiner

*Primary Examiner* — Joshua T Semick
(74) *Attorney, Agent, or Firm* — Harris Beach PLLC

(57) ABSTRACT

A rifle star chamber cleaning tool body includes a through hole disposed along a rifle star chamber tool body long axis. At least one end of the through hole includes a groove or slot. The through hole is adapted to slidingly and rotatingly accept a rod. The rifle star chamber cleaning tool body is shaped to slide at least in part into an upper receiver of a rifle. A method to clean a star chamber of an upper receiver of a rifle and a rifle star chamber cleaning tool are also described.

17 Claims, 43 Drawing Sheets

FIREARM CLEANING TOOLS

CROSS-REFERENCE TO RELATED APPLICATIONS

This application claims priority to and the benefit of U.S. provisional patent application Ser. No. 62/850,031, FIREARM CLEANING TOOLS, filed May 20, 2019, which application is incorporated herein by reference in its entirety.

FIELD OF THE APPLICATION

The application relates to firearm cleaning tools, particularly to cleaning tools and methods for the upper receiver and bolt carrier group of a rifle.

BACKGROUND

The upper receiver and components of the bolt carrier group including the bolt of a rifle or carbine should be cleaned after the weapon is fired and at regular intervals for best rifle performance and reliable operation.

SUMMARY

A rifle star chamber cleaning tool body includes a through hole disposed along a rifle star chamber tool body long axis. At least one end of the through hole includes a groove or slot, the through hole adapted to slidingly and rotatingly accept a rod. The rifle star chamber cleaning tool body is shaped to slide at least in part into an upper receiver of a rifle.

The groove or slot allows a rod to slide through the through hole where the rod includes a yaw angle with respect to the tool body long axis. The groove or slot can include a tapered groove or a tapered slot.

The rifle star chamber cleaning tool body can further include at least one scraper tool. The rifle star chamber cleaning tool body can further include a pry tool.

The rifle star chamber cleaning tool body can include an about flat or rectangular body sized to fit into a shell ejection port of an upper receiver.

The rifle star chamber cleaning tool body can further include a key shaped to fit into a charging handle notch of an upper receiver to be cleaned.

A method to clean a star chamber of an upper receiver of a rifle includes: providing a rifle star chamber cleaning tool body, and rod, a T-handle adapted to be coupled to a first end of the rod, and a scraper tool adapted to be coupled to a second end of the rod; placing a rifle star chamber cleaning tool body at least part way and not fully engaged into an upper receiver of the rifle; aligning a rod coupled to a scraper tool shaft of a scraper tool at a yaw angle with respect to a long axis of the rifle star chamber cleaning tool body within a slot or groove opening about an end of the rifle star chamber cleaning tool body so that a scraper of the scraper tool can pass through in an inner diameter opening of the star chamber and placed behind a plurality of locking lugs of the star chamber; fully engaging the rifle star chamber cleaning tool body into the upper receiver to cause the scraper tool shaft of the scraper tool to substantially center along the long axis of the rifle star chamber cleaning tool body; and rotating the rod to cause the scraper to rotate within the star chamber to clean the star chamber behind the locking lugs.

The step of fully engaging, can include pushing a flat or rectangular rifle star chamber cleaning tool body to an edge of an ejection port of the upper receiver closest to the star chamber.

The step of fully engaging, can include pushing a rifle star chamber cleaning tool body into an upper receiver to fully engage a key into a charge handle notch.

A rifle star chamber cleaning tool includes a rifle star chamber cleaning tool body. A rod has a rod longitudinal axis and a first rod end and a second rod end. A T-Handle is coupled to the first rod end. A scraper tool is removeably coupled to the second rod end. A through hole is disposed in about a center of the rifle star chamber cleaning tool body along a tool body long axis and at least one end of the through hole includes a groove or slot. The rod is rotatingly and slidingly disposed in the through hole. The rifle cleaning tool body is shaped to slide at least in part into an upper receiver of a rifle.

By way of the groove or slot, during insertion of the scraper tool into a star chamber, the rod has a yaw angle with respect to the tool body long axis to allow an insertion of the scraper tool into and through an inner diameter of a plurality of locking lugs of a star chamber of a rifle.

A method to clean a star chamber of an upper receiver of a rifle includes: providing a rifle star chamber cleaning tool including a rifle star chamber cleaning tool body, a rod having a rod longitudinal axis and a first rod end and a second rod end, a T-Handle coupled to the first rod end, a scraper tool having a scraper blade, the scraper tool removeably coupled to the second rod end, a through hole disposed in about a center of the rifle star chamber cleaning tool body along a tool body long axis and at least one end of the through hole including a groove or slot, the rod rotatingly and slidingly disposed in the through hole; sliding the rifle cleaning tool body at least in part into an upper receiver of a rifle; advancing the scraper tool is advanced into a recessed area of the star chamber behind a plurality of locking lugs; advancing the rifle star chamber cleaning tool body toward the star chamber to place the rod in a coaxial position with the through hole in the cleaning tool body, and with the rod in a coaxial position in the through hole; and rotating the blade of the scraper tool in close relationship to a wall of the recessed area for removal of dirt and residue accumulated from firing the rifle The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

FIG. 38 is a close-up view of an exemplary T-Handle;

FIG. 39 is a drawing showing the lower version tool inserted into an assembled AR as a safety block; and FIG. 40 is another drawing showing the lower version tool blocking the bolt carrier group.

DETAILED DESCRIPTION

Figure 1E:
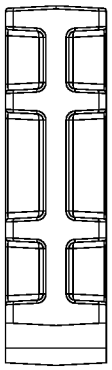
FIG. 1E is a drawing showing a front view of the lower version tool of FIG. 1A.
Figure 1B:
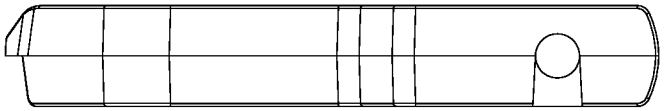
FIG. 1B is a drawing showing a top view of the lower version tool of FIG. 1A.
Figure 1A:
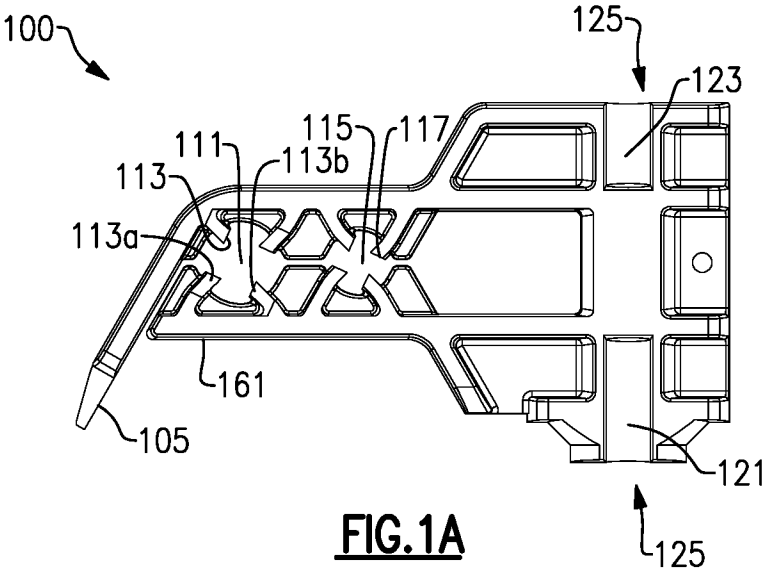
FIG. 1A is a drawing showing a right side view of an exemplary lower version tool.
Figure 1C:
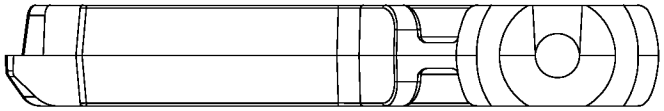
FIG. 1C is a drawing showing a bottom view of the lower version tool of FIG. 1A.
Figure 1D:
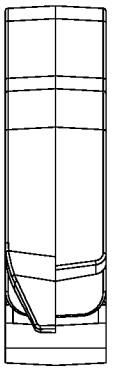
FIG. 1D is a drawing showing a back view of the lower version tool of FIG. 1A.
Figure 2C:
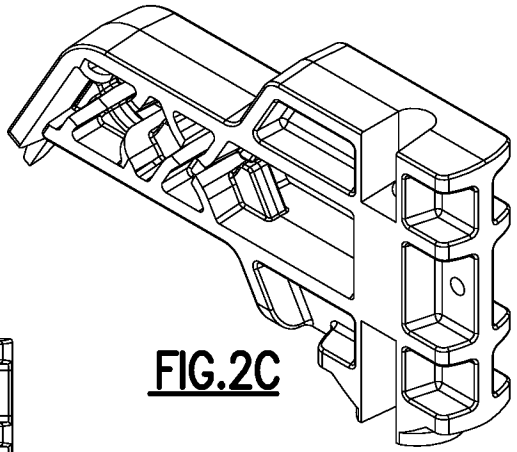
FIG. 2C is a drawing showing another isometric view of the lower version tool of FIG. 2A.
Figure 2E:
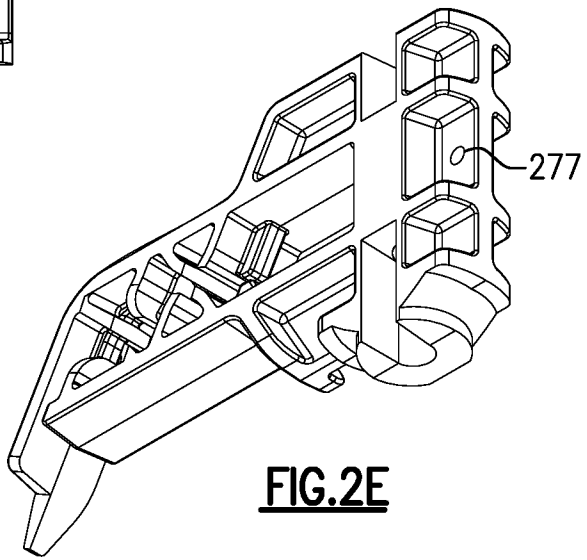
FIG. 2E is a drawing showing yet another isometric view of the lower version tool of FIG. 2A.
Figure 2A:
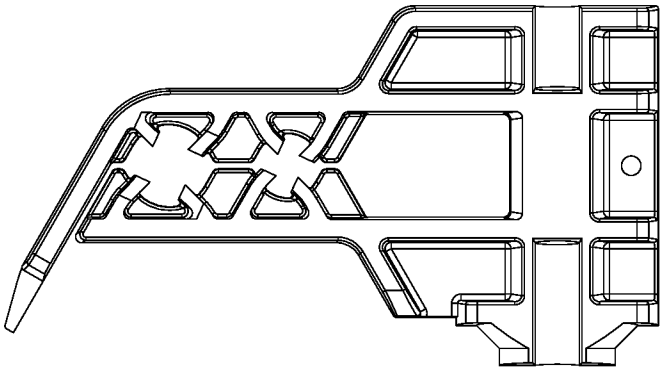
FIG. 2A is a drawing showing a right side view of a lower version tool.
Figure 2B:
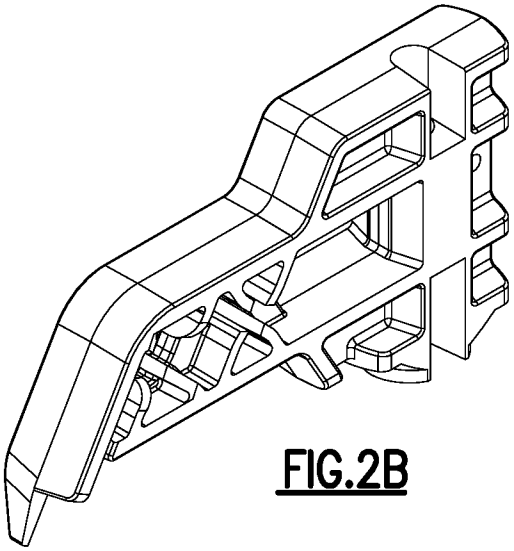
FIG. 2B is a drawing showing an isometric view of the lower version tool of FIG. 2A.
Figure 2D:
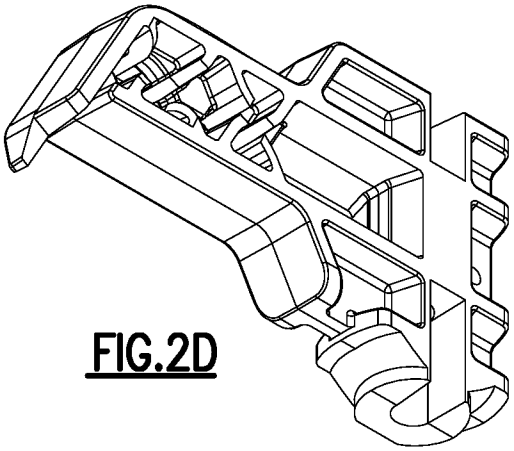
FIG. 2D is a drawing showing yet another isometric view of the lower version tool of FIG. 2A.
Figure 3D:
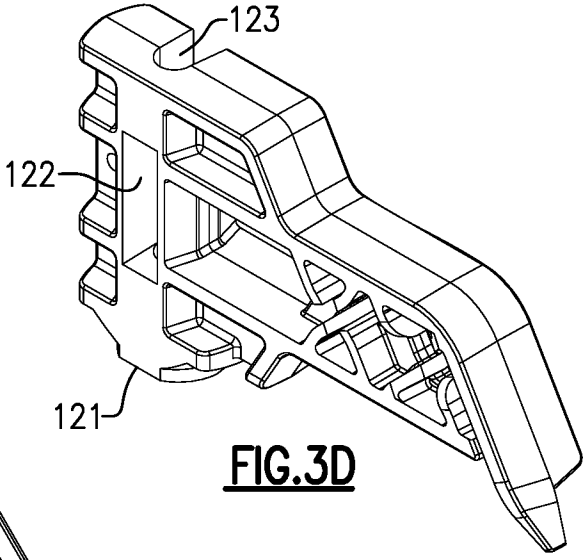
FIG. 3D is a drawing showing yet another isometric view of the lower version tool of FIG. 3A.
Figure 3E:
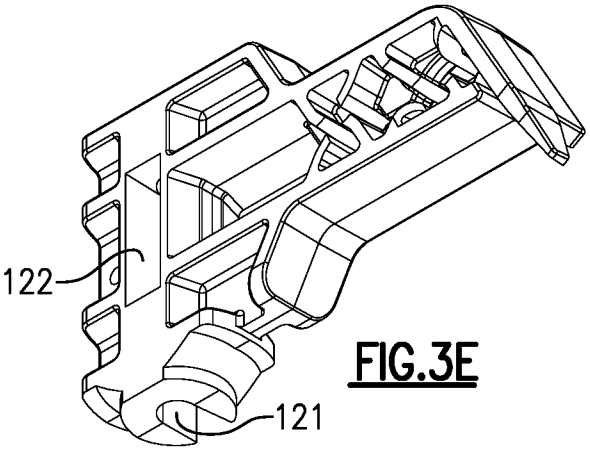
FIG. 3E is a drawing showing yet another isometric view of the lower version tool of FIG. 3A.
Figure 3A:
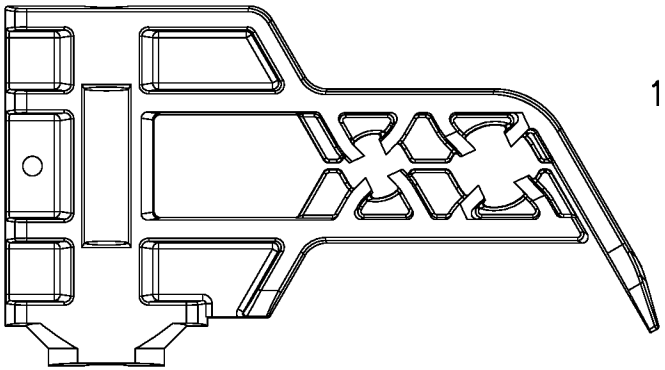
FIG. 3A is a drawing showing a left side view of a lower version tool.
Figure 3B:
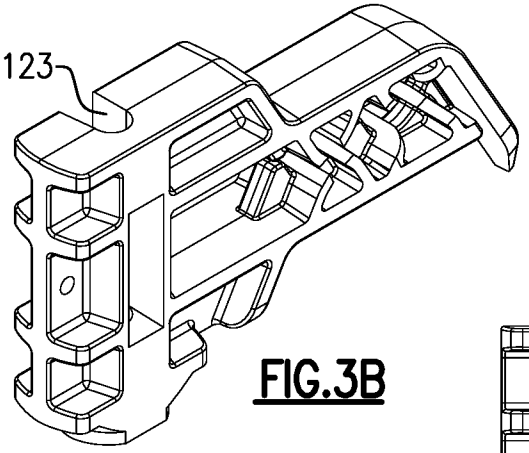
FIG. 3B is a drawing showing an isometric view of the lower version tool of FIG. 3A.
Figure 3C:
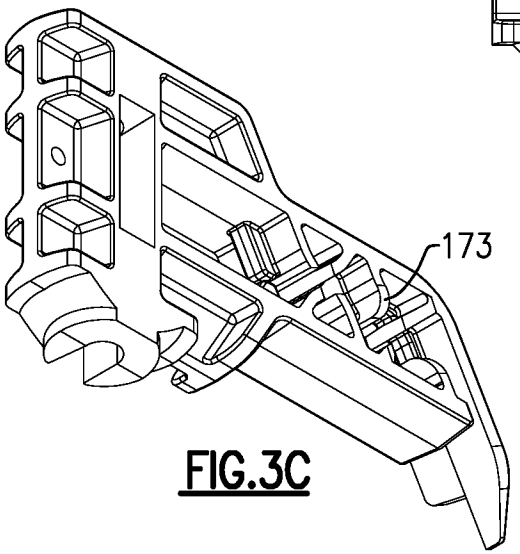
FIG. 3C is a drawing showing another isometric view of the lower version tool of FIG. 3A.
Figures 4A, 4B, 4C, 4D, 4E:
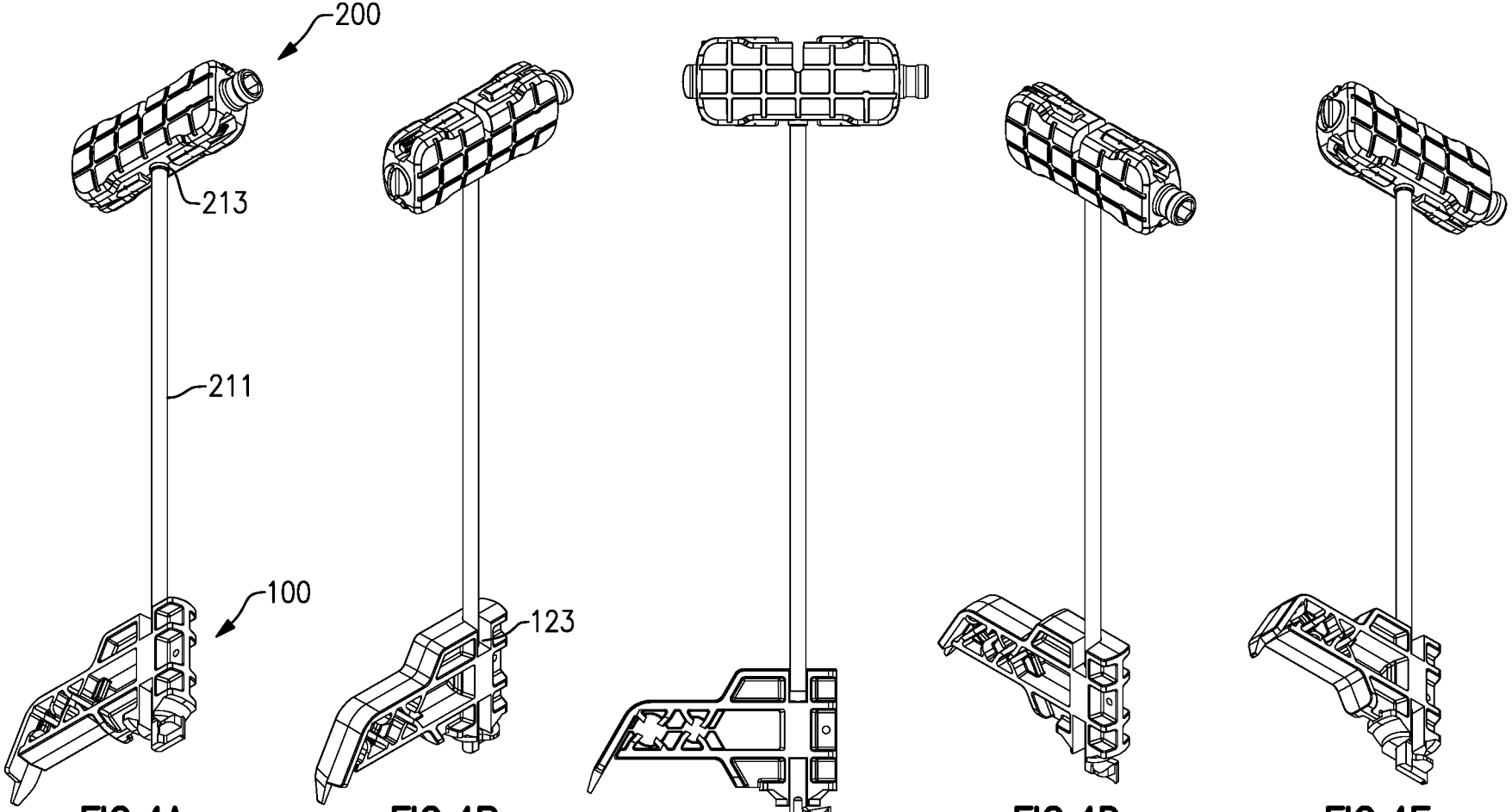
FIG. 4A is a drawing showing a right side view of an exemplary lower version tool assembled.
FIG. 4B is a drawing showing an isometric view of the lower version tool of FIG. 4A.
FIG. 4C is a drawing showing another isometric view of the lower version tool of FIG. 4A.
FIG. 4D is a drawing showing yet another isometric view of the lower version tool of FIG. 4A.
FIG. 4E is a drawing showing yet another isometric view of the lower version tool of FIG. 4A.
Figure 5E:
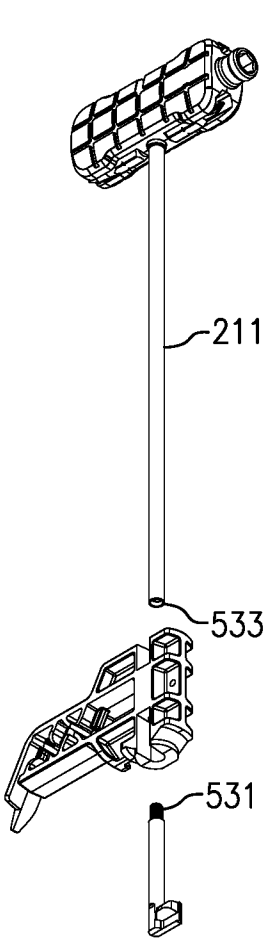
FIG. 5E is a drawing showing yet another isometric view of the lower version tool of FIG. 5A.
Figure 5D:
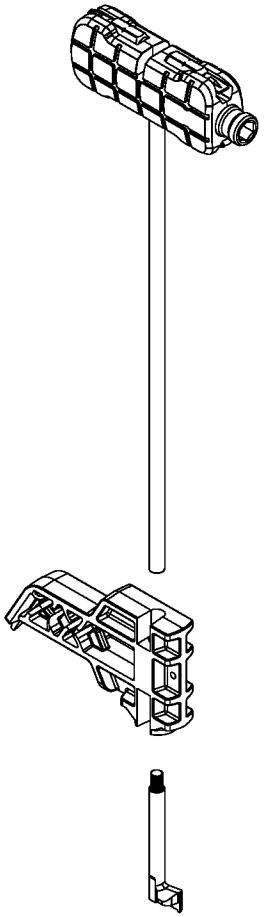
FIG. 5D is a drawing showing yet another isometric view of the lower version tool of FIG. 5A.
Figure 5C:
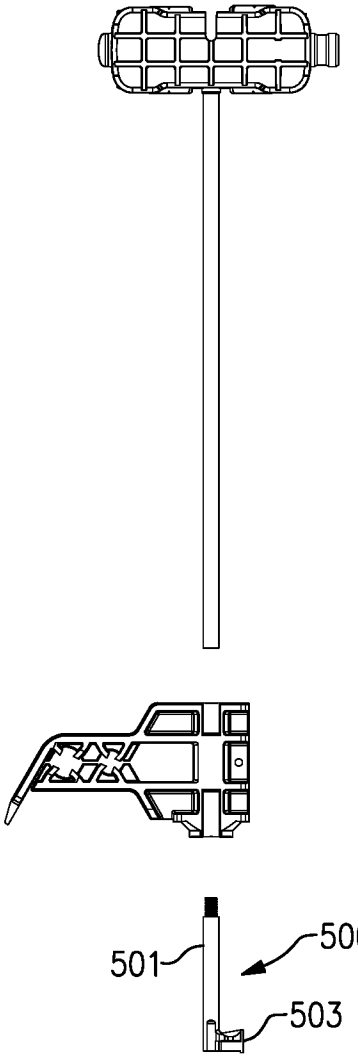
FIG. 5C is a drawing showing another isometric view of the lower version tool of FIG. 5A.
Figure 5B:
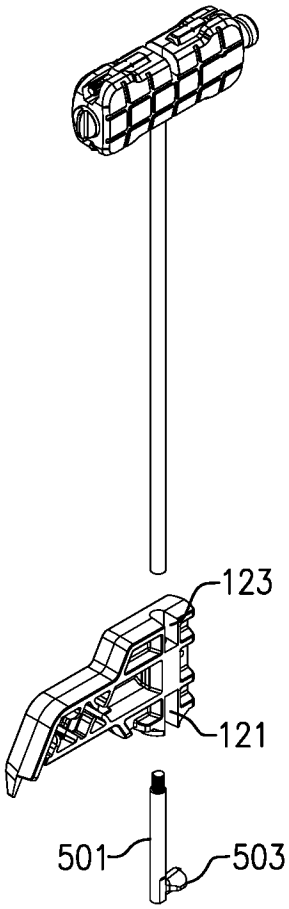
FIG. 5B is a drawing showing an isometric view of the lower version tool of FIG. 5A.
Figure 5A:
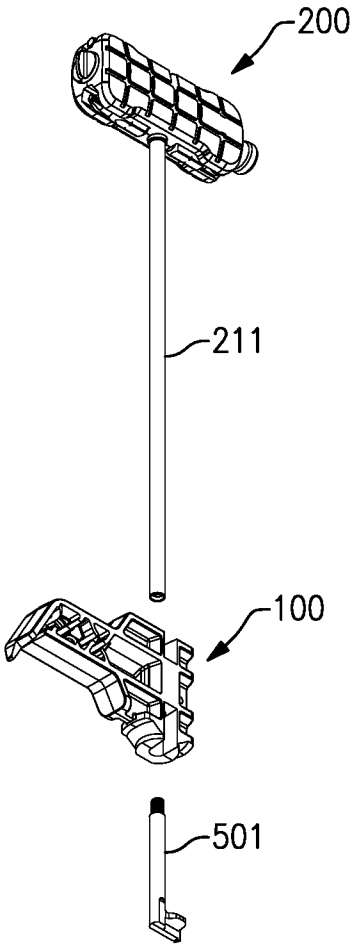
FIG. 5A is a drawing showing a right side exploded view of an exemplary lower version tool.
Figure 6C:
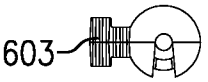
FIG. 6C is a drawing showing a top view of the full version tool of FIG. 6A.
Figure 6B:
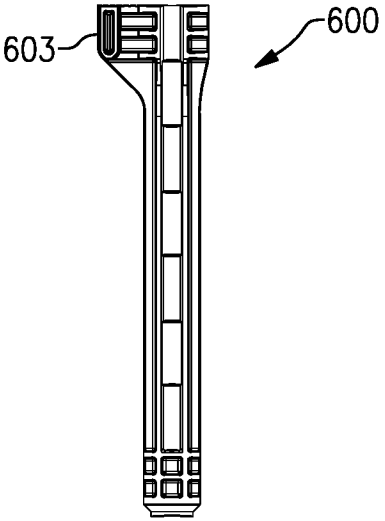
FIG. 6B is a drawing showing a right side view of the full version tool of FIG. 6A.
Figure 6E:
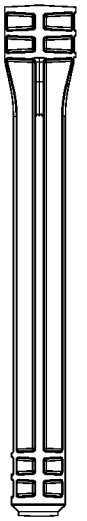
FIG. 6E is a drawing showing a front view of the full version tool of FIG. 6A.
Figure 6D:
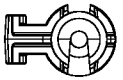
FIG. 6D is a drawing showing a bottom view of the full version tool of FIG. 6A.
Figure 6A:
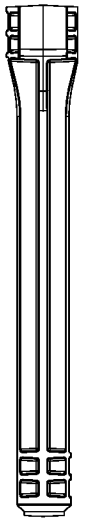
FIG. 6A is a drawing showing a back view of an exemplary full version tool.
Figure 7D:
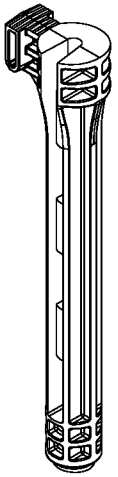
FIG. 7D is a drawing showing yet another isometric view of the full version tool of FIG. 7A.
Figure 7E:
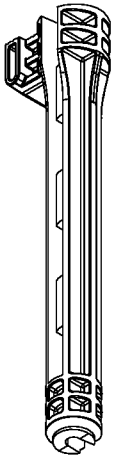
FIG. 7E is a drawing showing yet another isometric view of the full version tool of FIG. 7A.
Figure 7A:
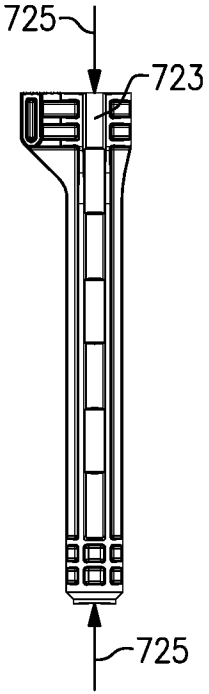
FIG. 7A is a drawing showing a right side view of a full version tool.
Figure 7B:
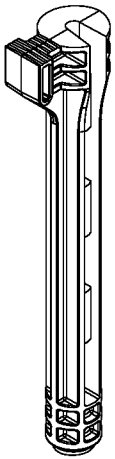
FIG. 7B is a drawing showing an isometric view of the full version tool of FIG. 7A.
Figure 7C:
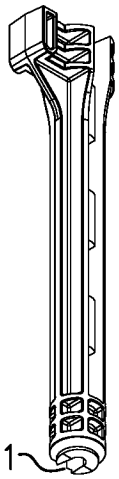
FIG. 7C is a drawing showing another isometric view of the full version tool of FIG. 7A.
Figure 8D:
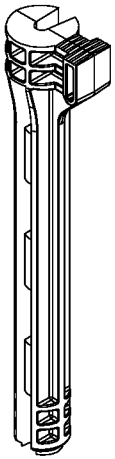
FIG. 8D is a drawing showing yet another isometric view of the full version tool of FIG. 8A.
Figure 8E:
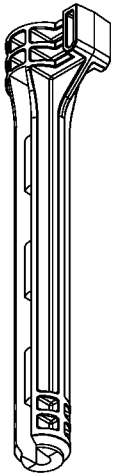
FIG. 8E is a drawing showing yet another isometric view of the full version tool of FIG. 8A.
Figure 8A:
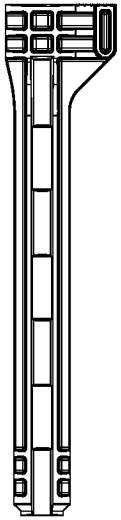
FIG. 8A is a drawing showing a left side view of a full version tool.
Figure 8B:
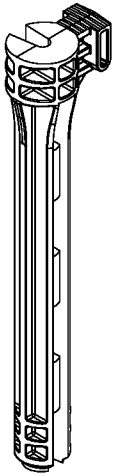
FIG. 8B is a drawing showing an isometric view of the full version tool of FIG. 8A.
Figure 8C:
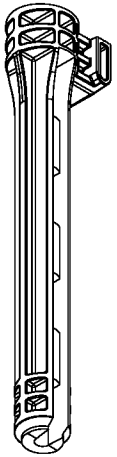
FIG. 8C is a drawing showing another isometric view of the full version tool of FIG. 8A.
Figure 9E:
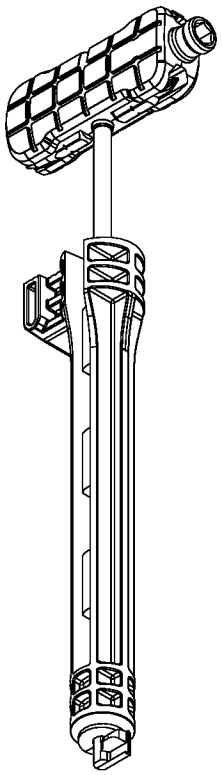
FIG. 9E is a drawing showing yet another isometric view of the full version tool of FIG. 9A.
Figure 9D:
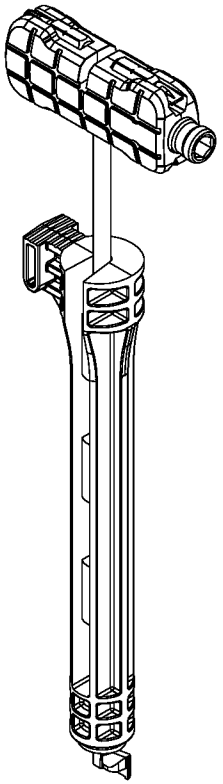
FIG. 9D is a drawing showing yet another isometric view of the full version tool of FIG. 9A.
Figure 9A:
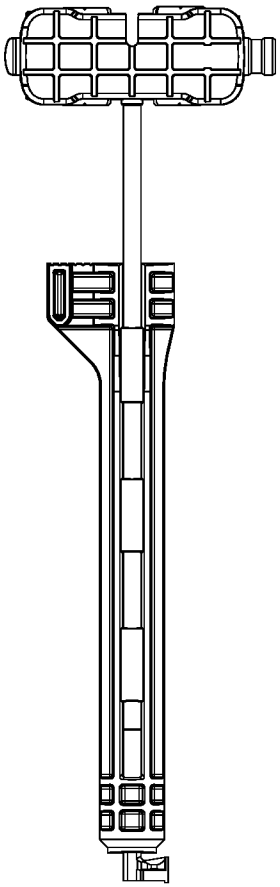
FIG. 9A is a drawing showing a right side view of a full version tool assembled with a T handle.
Figure 9C:
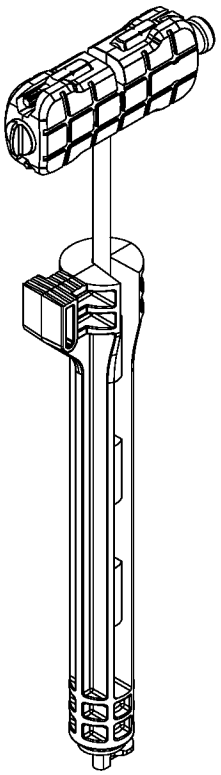
FIG. 9C is a drawing showing another isometric view of the full version tool of FIG. 9A.
Figure 9B:
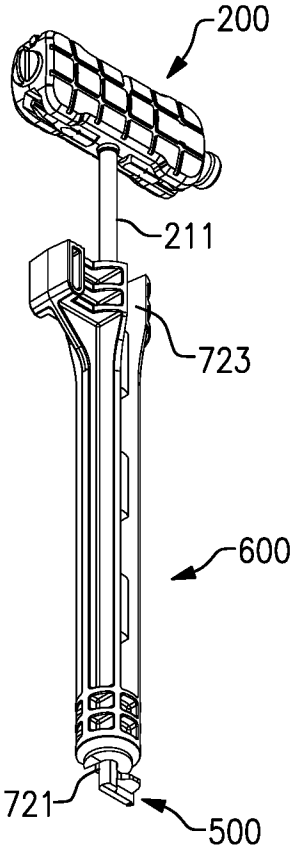
FIG. 9B is a drawing showing an isometric view of the full version tool of FIG. 9A.
Figure 10B:
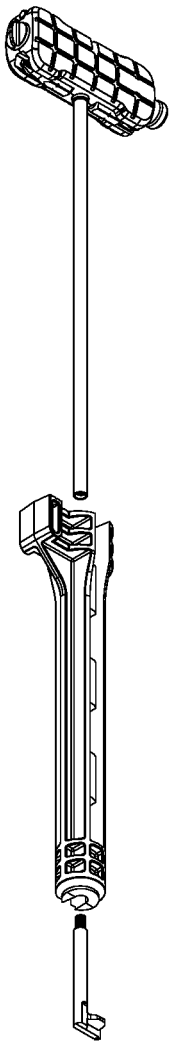
FIG. 10B is a drawing showing an isometric view of the full version tool of FIG. 10A.
Figure 10C:
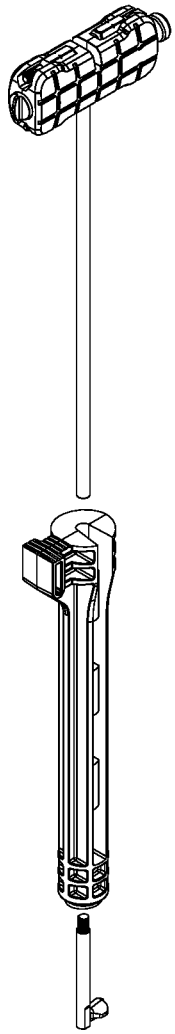
FIG. 10C is a drawing showing another isometric view of the full version tool of FIG. 10A.
Figure 10A:
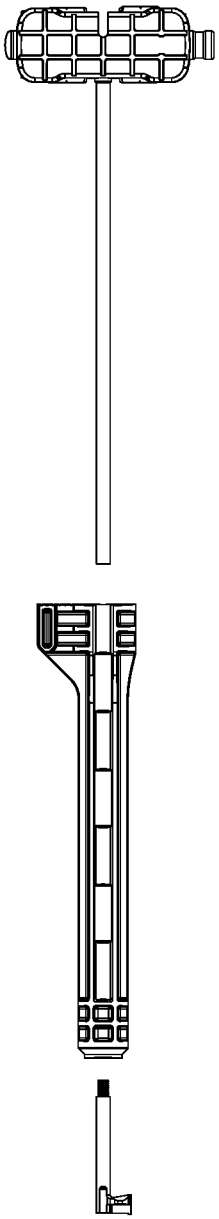
FIG. 10A is a drawing showing a right side exploded view of a full version tool with a T handle.
Figure 10D:
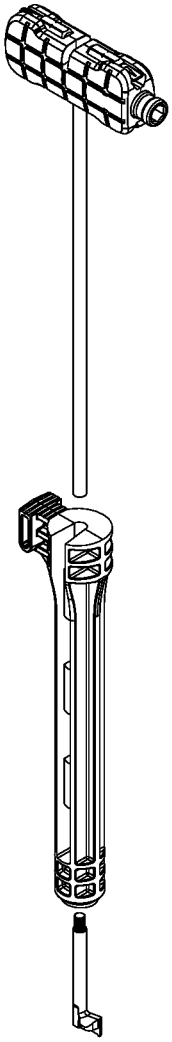
FIG. 10D is a drawing showing yet another isometric view of the full version tool of FIG. 10A.
Figure 10E:
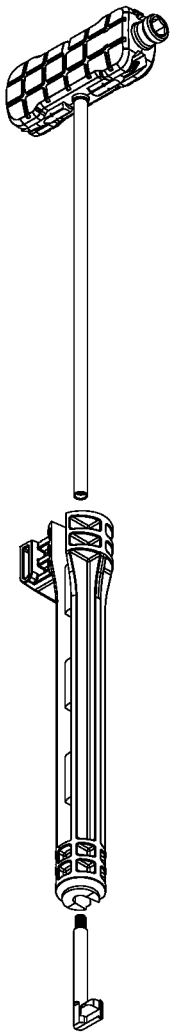
FIG. 10E is a drawing showing yet another isometric view of the full version tool of FIG. 10A.
Figure 11C:
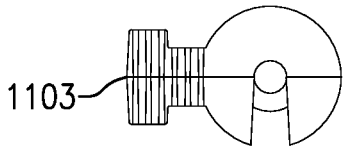
FIG. 11C is a drawing showing a top view of the upper version tool of FIG. 11A.
Figure 11B:
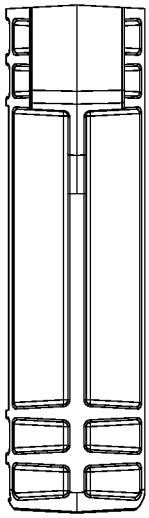
FIG. 11B is a drawing showing a back view of the upper version tool of FIG. 11A.
Figure 11A:
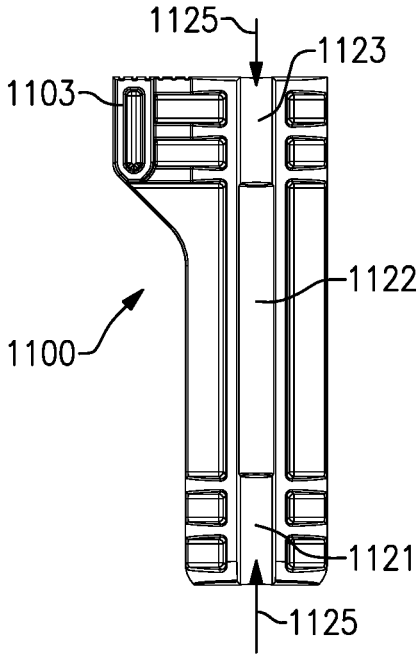
FIG. 11A is a drawing showing a right side view of an exemplary upper version tool.
Figure 11E:
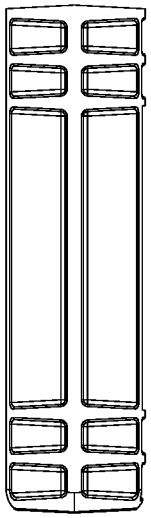
FIG. 11E is a drawing showing a front view of the upper version tool of FIG. 11A.
Figure 11D:
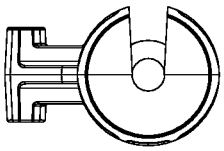
FIG. 11D is a drawing showing a bottom view of the upper version tool of FIG. 11A.
Figure 12B:
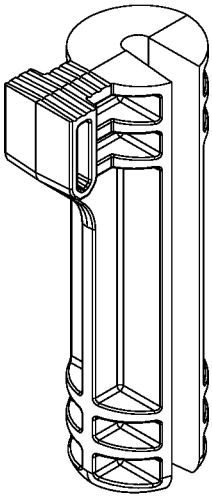
FIG. 12B is a drawing showing an isometric view of the upper version tool of FIG. 12A.
Figure 12A:
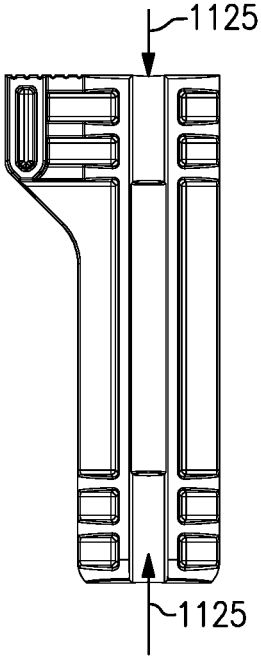
FIG. 12A is a drawing showing a right side view of an exemplary upper version tool.
Figure 12D:
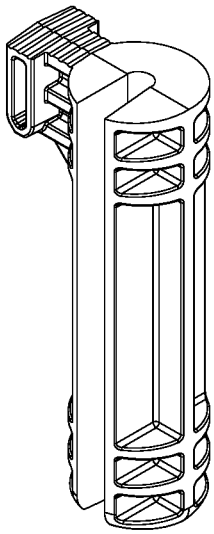
FIG. 12D is a drawing showing yet another isometric view of the upper version tool of FIG. 12A.
Figure 12C:
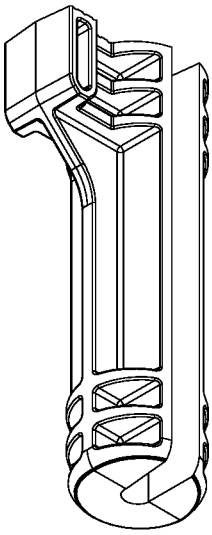
FIG. 12C is a drawing showing another isometric view of the upper version tool of FIG. 12A.
Figure 12E:
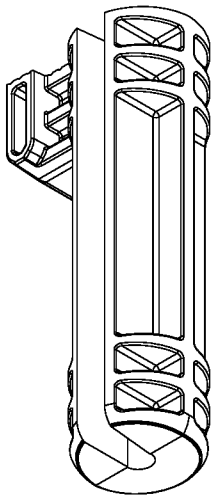
FIG. 12E is a drawing showing yet another isometric view of the upper version tool of FIG. 12A.
Figure 13B:
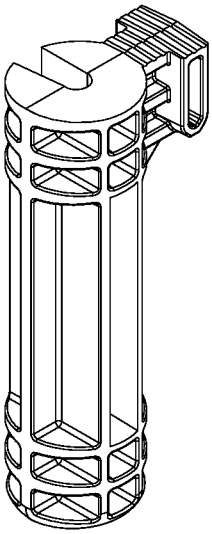
FIG. 13B is a drawing showing an isometric view of the upper version tool of FIG. 13A.
Figure 13A:
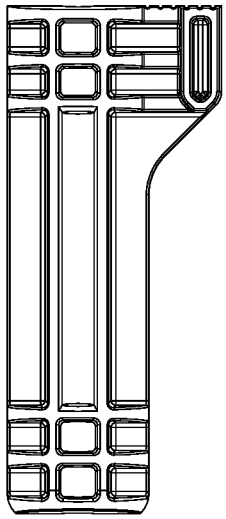
FIG. 13A is a drawing showing a left side view of an exemplary upper version tool.
Figure 13D:
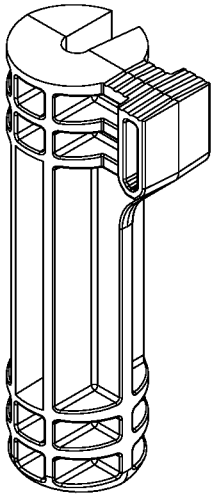
FIG. 13D is a drawing showing yet another isometric view of the upper version tool of FIG. 13A.
Figure 13C:
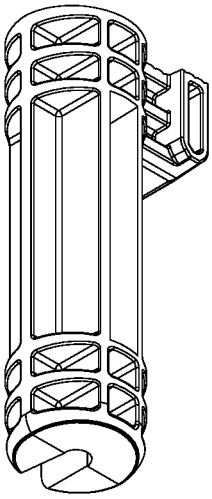
FIG. 13C is a drawing showing another isometric view of the upper version tool of FIG. 13A.
Figure 13E:
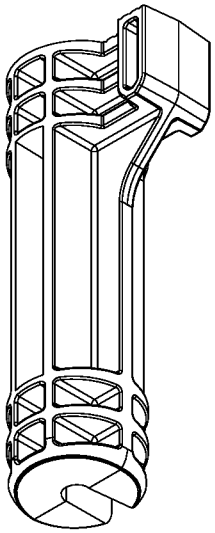
FIG. 13E is a drawing showing yet another isometric view of the upper version tool of FIG. 13A.
Figure 14E:
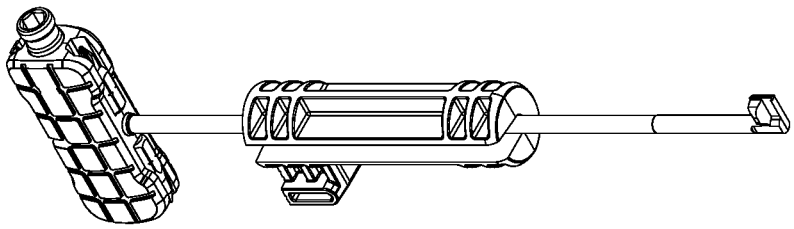
FIG. 14E is a drawing showing yet another isometric view of the upper version tool of FIG. 14A.
Figure 14D:
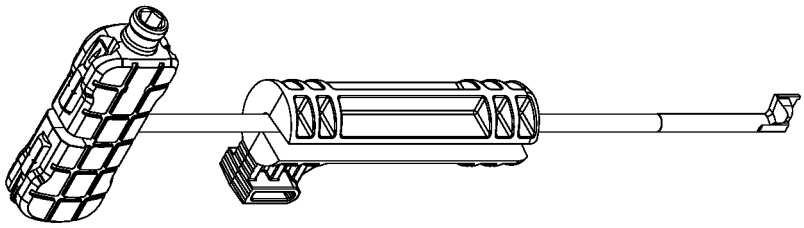
FIG. 14D is a drawing showing yet another isometric view of the upper version tool of FIG. 14A.
Figure 14A:
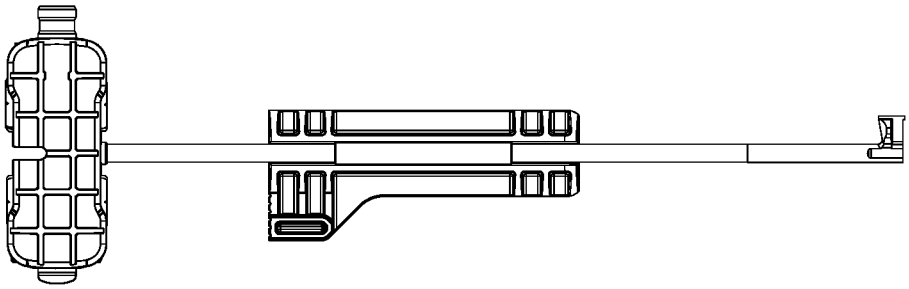
FIG. 14A is a drawing showing a right side view of an exemplary assembled upper version tool with T handle.
Figure 14C:
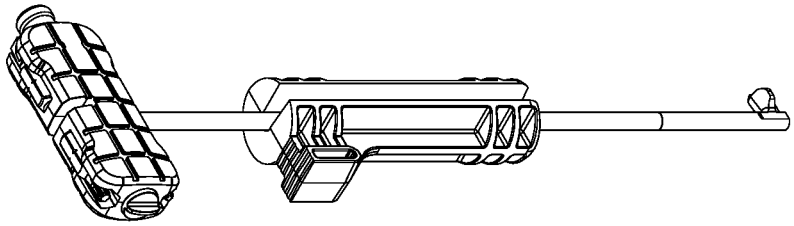
FIG. 14C is a drawing showing another isometric view of the upper version tool of FIG. 14A.
Figure 14B:
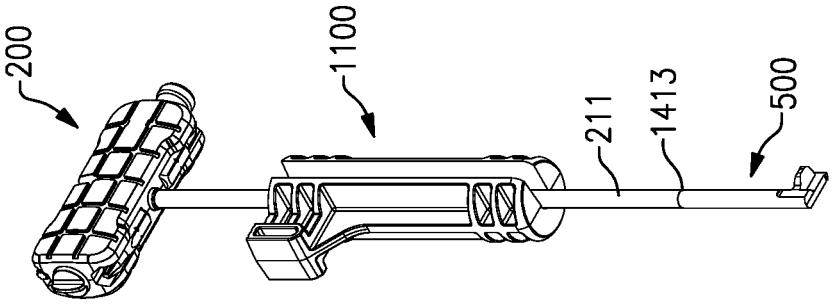
FIG. 14B is a drawing showing an isometric view of the upper version tool of FIG. 14A.
Figure 15B:
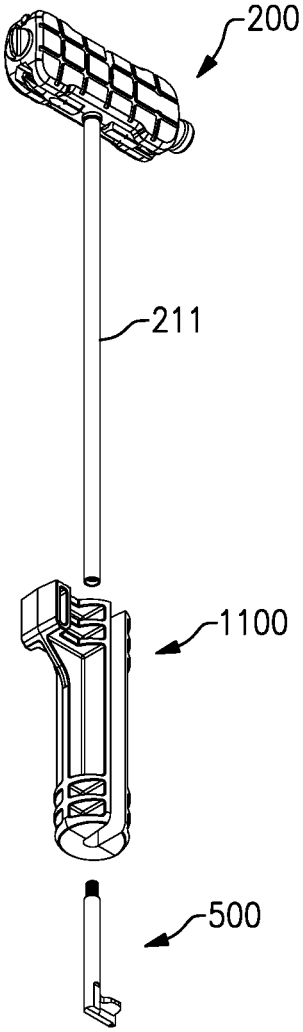
FIG. 15B is a drawing showing an isometric view of the upper version tool of FIG. 15A.
Figure 15C:
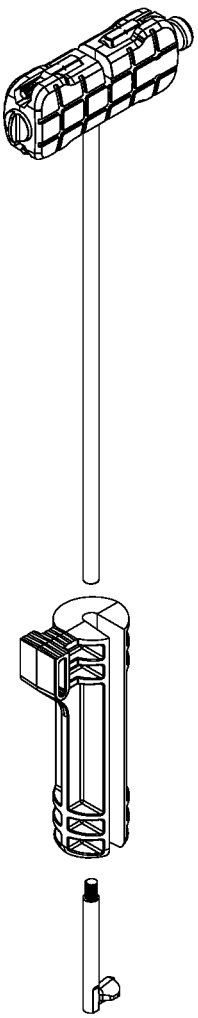
FIG. 15C is a drawing showing another isometric view of the upper version tool of FIG. 15A.
Figure 15A:
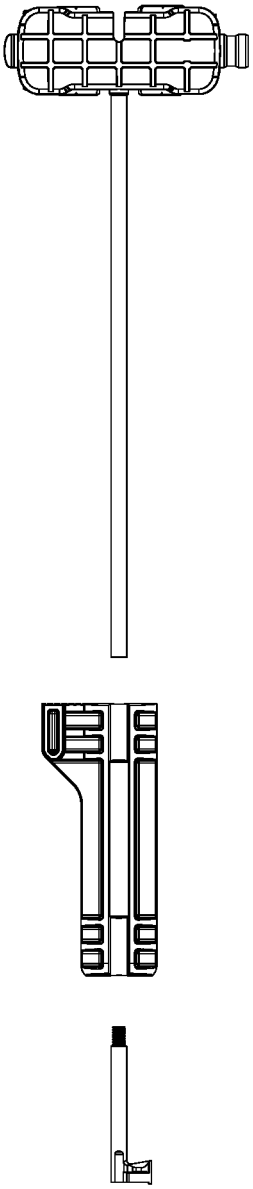
FIG. 15A is a drawing showing a right side exploded view of an exemplary upper version tool with T handle.
Figure 15D:
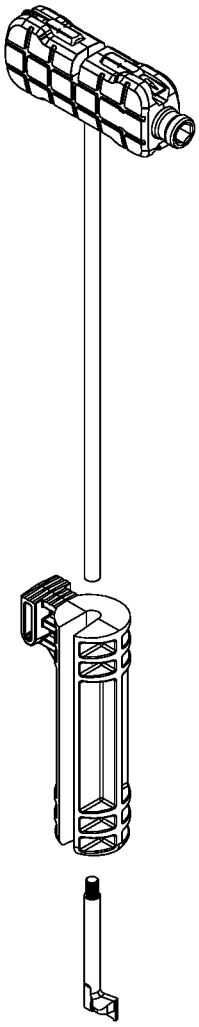
FIG. 15D is a drawing showing yet another isometric view of the upper version tool of FIG. 15A.
Figure 15E:
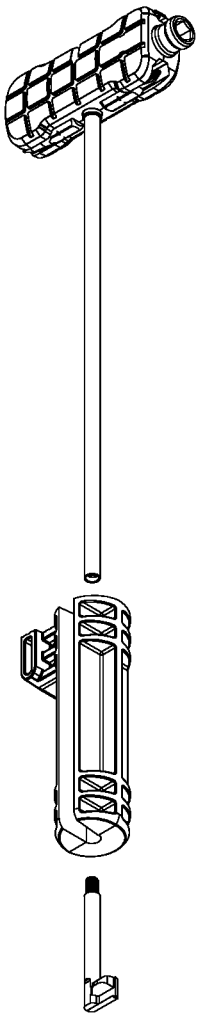
FIG. 15E is a drawing showing yet another isometric view of the upper version tool of FIG. 15A.
Figure 16C:
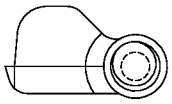
FIG. 16C is a drawing showing a top view of the scraper tool of FIG. 16A.
Figure 16B:
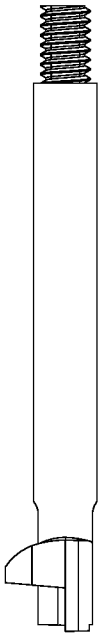
FIG. 16B is a drawing showing a back view of the scraper tool of FIG. 16A.
Figure 16A:
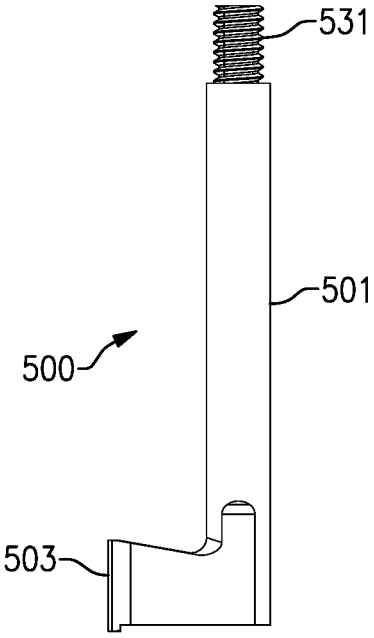
FIG. 16A is a drawing showing a right side view of an exemplary scraper tool.
Figure 16E:
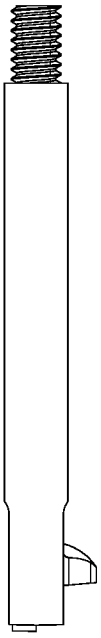
FIG. 16E is a drawing showing a front view of the scraper tool of FIG. 16A.
Figure 16D:
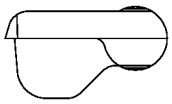
FIG. 16D is a drawing showing a bottom view of the scraper tool of FIG. 16A.
Figure 17B:
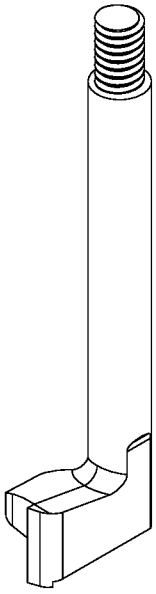
FIG. 17B is a drawing showing an isometric view of the scraper tool of FIG. 17A.
Figure 17A:
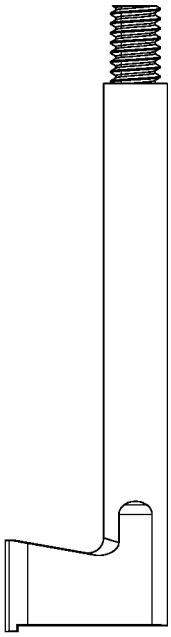
FIG. 17A is a drawing showing a right side view of a scraper tool.
Figure 17D:
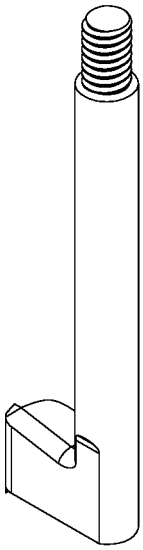
FIG. 17D is a drawing showing yet another isometric view of the scraper tool of FIG. 17A.
Figure 17C:
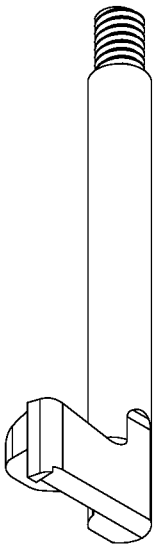
FIG. 17C is a drawing showing another isometric view of the scraper tool of FIG. 17A.
Figure 17E:
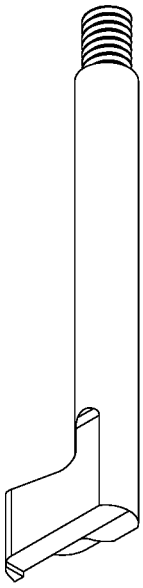
FIG. 17E is a drawing showing yet another isometric view of the scraper tool of FIG. 17A.
Figure 18B:
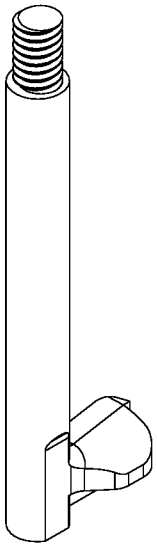
FIG. 18B is a drawing showing an isometric view of the scraper tool of FIG. 18A.
Figure 18A:
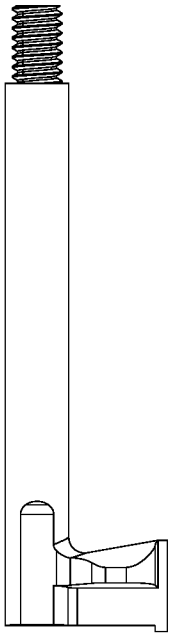
FIG. 18A is a drawing showing a left side view of a scraper tool.
Figure 18D:
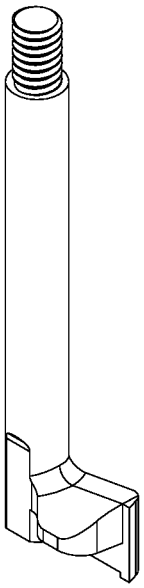
FIG. 18D is a drawing showing yet another isometric view of the scraper tool of FIG. 18A.
Figure 18C:
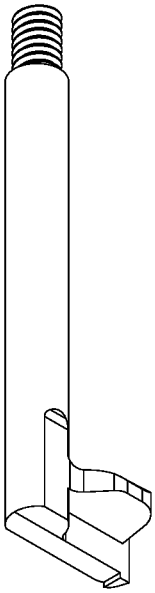
FIG. 18C is a drawing showing another isometric view of the scraper tool of FIG. 18A.
Figure 18E:
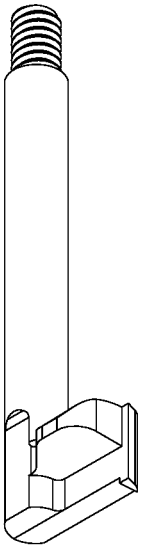
FIG. 18E is a drawing showing yet another isometric view of the scraper tool of FIG. 18A.
Figure 19D:
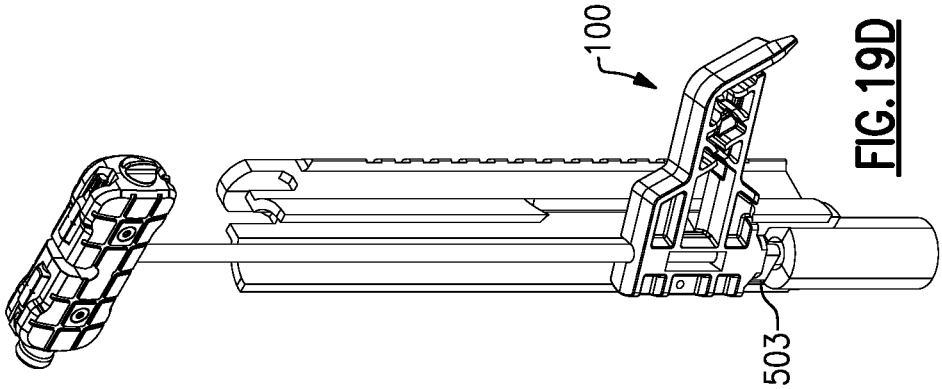
FIG. 19D is a drawing showing a second side view of the lower version tool in of FIG. 19A where the AR upper is partially cut-away.
Figure 19C:
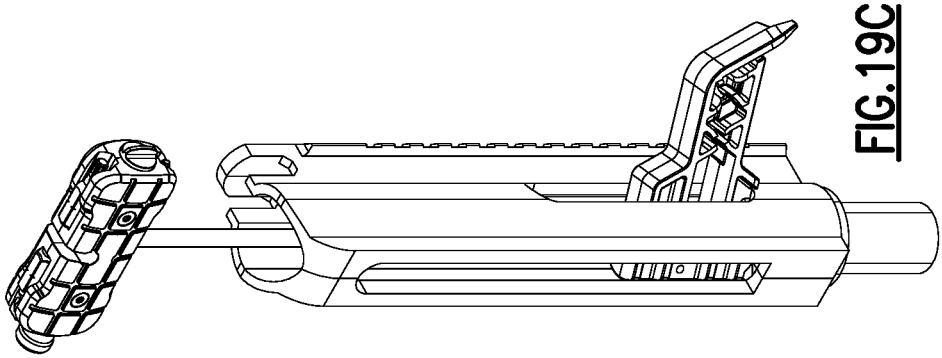
FIG. 19C is a drawing showing an isometric view of the lower version tool in of FIG. 19A.
Figure 19B:
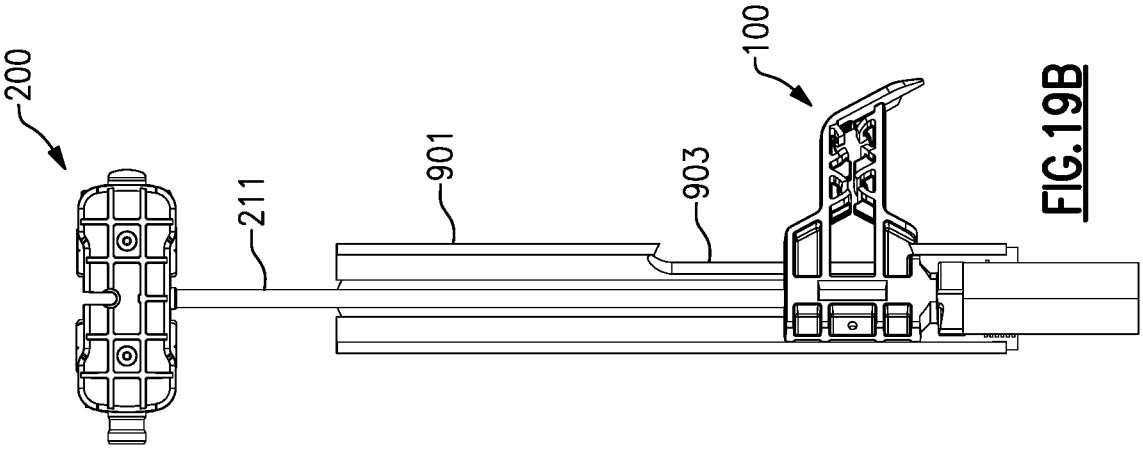
FIG. 19B is a drawing showing a second side view of the lower version tool in of FIG. 19A.
Figure 19A:
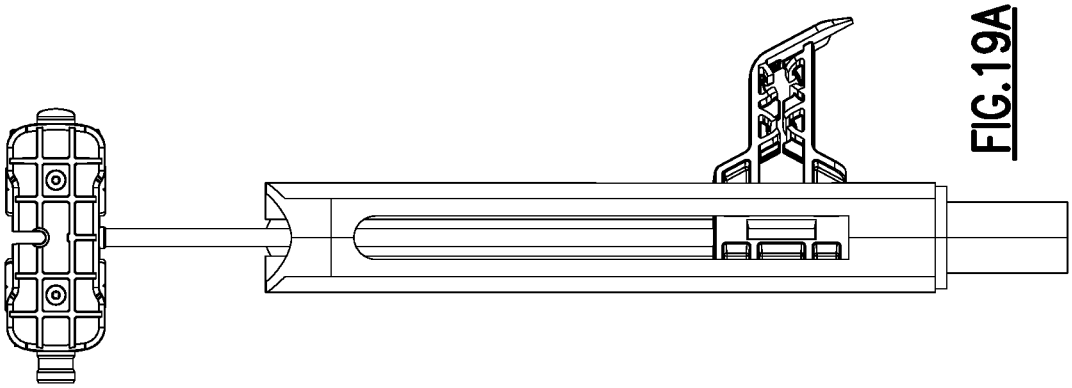
FIG. 19A is a drawing showing a first side view of an exemplary lower version tool in an AR upper.
Figure 20D:
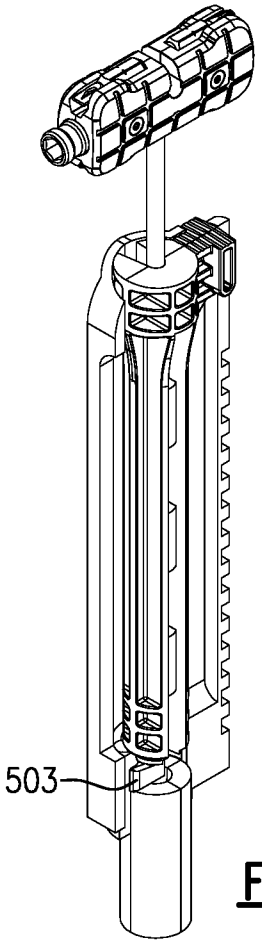
FIG. 20D is a drawing showing another isometric view of the full version tool in of FIG. 20A where the AR is partially cut-away.
Figure 20C:
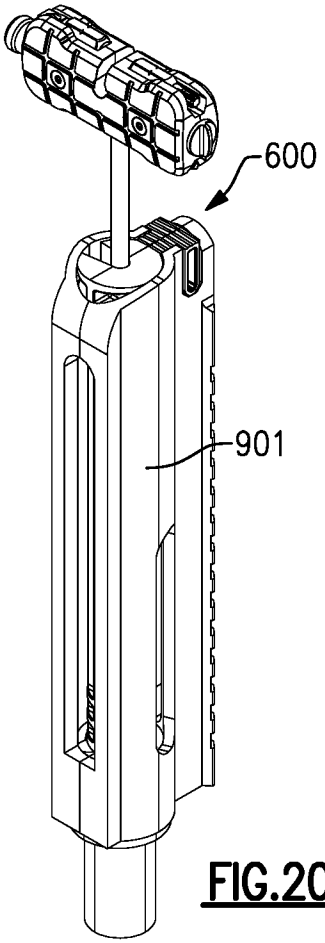
FIG. 20C is a drawing showing an isometric view of the full version tool in of FIG. 20A.
Figure 20B:
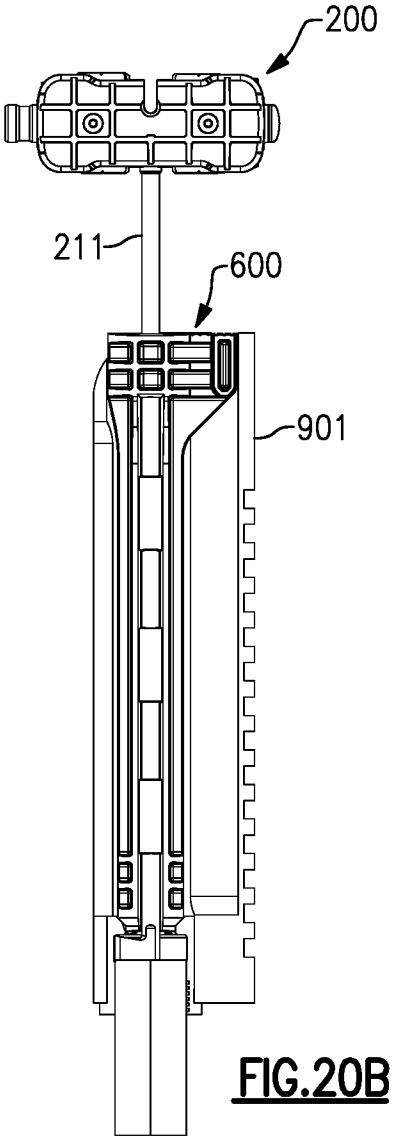
FIG. 20B is a drawing showing the full version tool in of FIG. 20A in a partially cut-away AR upper.
Figure 20A:
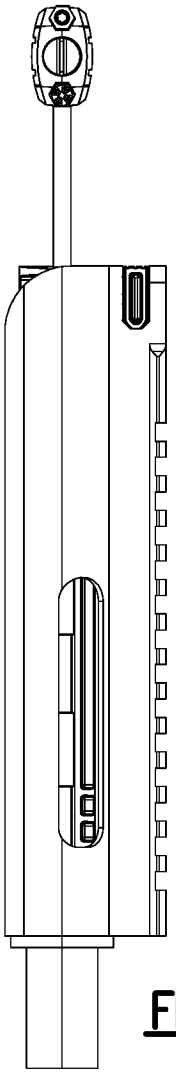
FIG. 20A is a drawing showing a first side view of an exemplary full version tool in an AR upper.
Figure 21A:
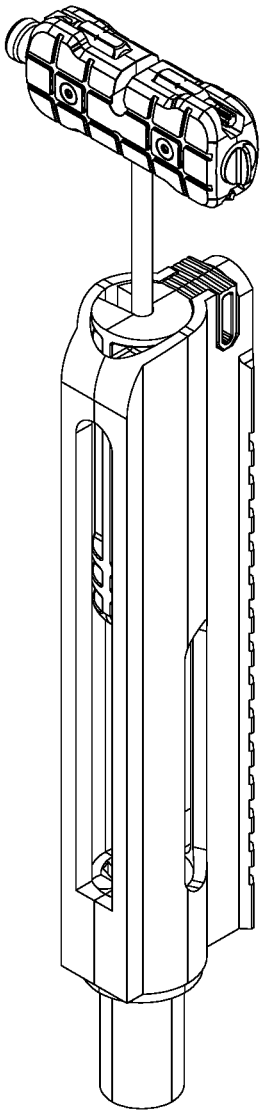
FIG. 21A is a drawing showing an isometric view of an exemplary full version tool in an AR upper.
Figure 21B:
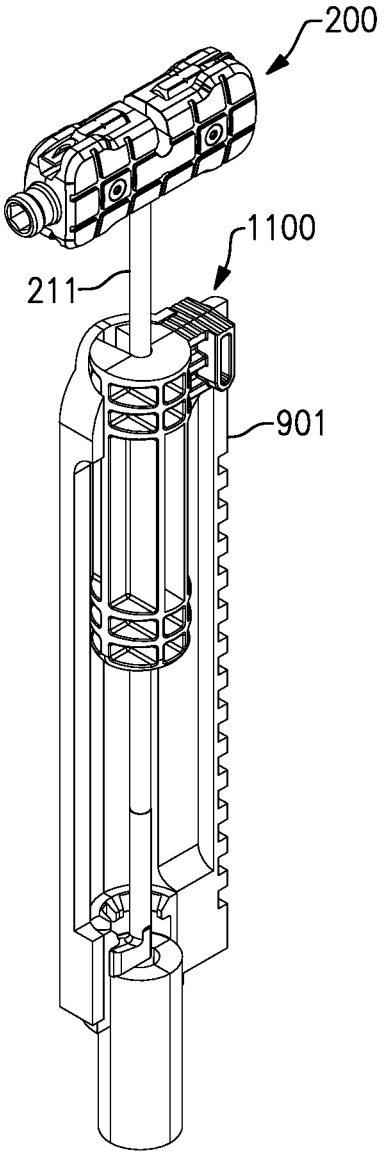
FIG. 21B is a drawing showing the full version tool in of FIG. 21A in a partially cut-away AR upper with more detail of the star chamber shown.
Figure 21C:
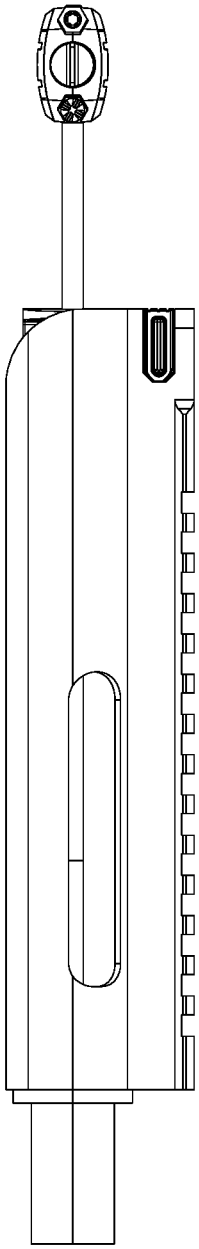
FIG. 21C is a drawing showing a side view of the full version tool in of FIG. 21A.
Figure 21D:
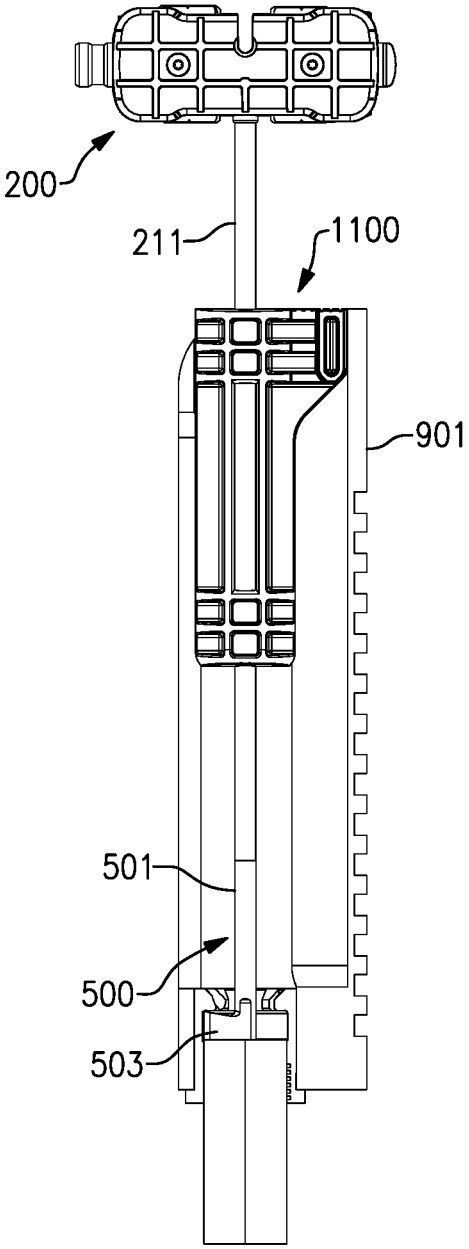
FIG. 21D is a drawing showing another isometric view of the full version tool in of FIG. 21A where the AR is partially cut-away and with the scraper in the star chamber.

The description which follows is divided into 4 parts. The parts each describe various components and methods of a new rifle cleaning system. The new cleaning system is described with respect to an exemplary AR type rifle, such as the AR 15 and variants thereof. Those skilled in the art will understand that similar component can be provided with the new combinations of cleaning features for other type rifles, such as, for example, M4, .308 rifles, etc. For example, by reference to one exemplary line of rifles manufactured by the Lewis Machine & Tool Company (LMT) of Milan, Ill., the tool is suitable for use with an can be dimensioned for any of the MRP carbine, MRP rifles, and MWS platforms, including 5.56 NATO, 6.8 SPC, 300 BLACKOUT, .224 VALKYRIE, 308 WIN, 6.5 CM, 260 REM, .243 REM, .243 WIN, 7-MM-08 REM, AND .338 FED, as merely exemplary of rifle types made by LMT and by many other manufacturers, which can be cleaned by one or more sizes of the new rifle cleaning tool described herein. In the drawings, LMT exemplary rifle parts are shown merely for illustration purposes. Those skilled in the art will understand that the new cleaning tools and methods are not limited to particular models or models of rifles, including carbines, made by any particular manufacturer.

The description which follows is divided into 4 parts. The parts each describe various components and methods of a new rifle cleaning system. Part 1 describes a lower version tool; part 2 a full version tool; part 3 an upper version tool; and part 4, methods.

Part 1 Lower Version Tool.

FIG. 1A to FIG. 1E show drawings of an exemplary lower version tool 100. The lower version tool 100 includes a pry tool 105, two different diameter scraper tools 111, 115, with corresponding scrapers 113, 117.

Openings 121 and 123 provide entrances for a through rod to a through channel or through hole 125 through the lower version tool 100.

The lever arm 161 can be pressed by a thumb or finger as a pressure lever to press scrapers 113*a* and 113*b* against a part being rotated for cleaning by a scraping action, such as for example to clean the cylindrical surface of an AR bolt as described in more detail hereinbelow (See FIG. 30).

FIG. 2A to FIG. 2E show more drawing views of the lower version tool 100. Hole 277 can accept the firing pin retainer pin for safe storage during cleaning. See FIG. 25.

FIG. 3A to FIG. 3E show still more drawing views of the lower version tool 100. Note that the scrapers 113 include curved scraper portions 173 (e.g. FIG. 3C) which follow the curved face of the AR bolt to be cleaned.

FIG. 4A to FIG. 4E are drawings showing a T Handle 200, rod 211 and the lower version tool 100. In some applications of the lower version tool 100, rod 211 is inserted into through hole 125 and can rotate and slide there within through hole 125.

FIG. 5A to FIG. 5E are drawings showing a T Handle 200, rod 211, the lower version tool 100, and a scraper tool 500 having a scraper tool shaft 501 with scraper 503. Rod 211 can be threadingly coupled to the scraper tool shaft 501 where, for example, there can be male threads 531 at one end of the scraper tool shaft 501 corresponding to female threads within an end of rod 211. That way, rod 211 can be threadingly affixed to scraper tool 500 after rod 211 is passed through the through hole 125. Once so installed, rod 211 and scraper tool 500 can be both rotated and slidingly translated within the lower version tool 100.

Part 2 Full Version Tool

FIG. 6A to FIG. 6E are drawings showing an exemplary full version tool 600. Key 603 fits into the charge handle notch of an upper receiver to be cleaned, locking the full version tool 600 in place.

FIG. 7A to FIG. 7E are more drawings showing different views of the exemplary full version tool 600 including a right side view. Openings 721 and 723 provide entrances for a through rod to a through channel or through hole 725 through the full version tool 600.

FIG. 8A to FIG. 8E are more drawings showing different views of the exemplary full version tool 600 including a left side view.

FIG. 9A to FIG. 9E are drawings showing several views of the exemplary full version tool 600 used with a T-handle 200 and rod 211, and scraper tool 500 inserted into the full version tool 600. FIG. 10A to FIG. 10E are drawings showing more views of how the T-handle 200 and rod 211, and scraper tool 500 are inserted into the through hole 725 of the full version tool 600.

Part 3 Upper Version Tool

FIG. 11A to FIG. 11E are drawings showing an exemplary upper version tool 1100. Openings 1121 and 1123 provide entrances for a through rod to a through channel or through hole 1125 through the upper version tool 600. Key 1103 fits into the charge handle notch of an upper receiver to be cleaned, locking the upper version tool 1100 in place.

FIG. 12A to FIG. 12E are more drawings showing different views of the exemplary upper version tool 1100 including a right side view. FIG. 13A to FIG. 13E are more drawings showing different views of the exemplary upper version tool 1100 including a left side view.

FIG. 14A to FIG. 14E are drawings showing several views of the exemplary upper version tool 1100 used with a T-handle 200 and rod 211, and scraper tool 500 inserted into the upper version tool 1100.

FIG. 15A to FIG. 15E are drawings showing more views of how the T-handle 200 and rod 211, and scraper tool 500 inserted into the through hole 1125 (FIG. 12A) of the upper version tool 1100. In FIG. 15A to FIG. 15E, the exemplary scraper tool shaft 501 of scraper 500 has a male thread 531 which threads into a female threaded socket 533 of exemplary rod 211. The threaded sections can be reversed where rod 211 has a male thread which threads into a female threaded socket of a scraper tool shaft 501.

FIG. 16A to FIG. 16E are drawings showing an exemplary scraper tool 500. Scraper 503 is operated by motion of scraper shaft 501. Scraper shaft 501 can include male threads 531 to threadingly couple to a rod having corresponding female threads, such as rod 211 and threads 533.

FIG. 17A to FIG. 17E are more drawings showing different views of the exemplary scraper tool 500 including a right side view. FIG. 18A to FIG. 18E are yet more drawings showing different views of the exemplary scraper tool 500 including a left side view.

FIG. 19A to FIG. 19D are drawings showing the lower version tool 100 inserted into an exemplary upper receiver 901. The lower version tool 100 can be inserted through the shell ejection port 903 and then the rod 211 pushed through the through hole 125 (FIG. 1A) while the lower version tool 100 is in the upper receiver 900 of the rifle to be cleaned.

FIG. 20A to FIG. 20D are drawings showing the full version tool 600 inserted into an exemplary upper receiver 901.

FIG. 21A to FIG. 21D are drawings showing the upper version tool 1100 inserted into an exemplary upper receiver 901.

Part 4 Methods—Exemplary Use of a Lower Version Tool to Clean an Exemplary LMT AR Rifle.

Generally, the tool body performs the task of centering or off centering the scraper tool. This allows the scraper tool to scrap and clean behind the locking lugs/star chamber area. When the scraper is not fully engaged in the tool body it can pass thru the smaller diameter of the star chamber/locking lugs. When the scraper is engaged in the tool body the scraper is forced back to the centerline and sweeps a larger radius.

For example, when the tool body (100, 600, or 1100) is partially inserted into the upper receiver, because of the open end slots or grooves (100: openings 121, 123, of through hole 125; 600: openings 721, 723 of through hole 725; and 1100: openings 1121, 1123 or through hole 1125) the axis of scraper tool shaft 501 can be made to vary (skew in a sideways "yaw" direction with a "yaw angle") from the longitudinal axis of the through hole (same as the center long axis of the tool body). The openings can be any suitable slot, groove, or tapered slot or groove. The exemplary tool bodies show tapered groove end openings of the through holes. Because the openings allow the rod and scraper tool axis to vary slightly from the longitudinal axis of the through hole, as the tool body is placed in the upper receiver (slid in for 600, 1100, placed in the shell ejection port for the about flat or about rectangular tool body 100), in all cases, the scraper 503 can be inserted into the inside diameter of the locking lugs at the barrel end of the upper receiver. Once the scraper 503 is set into the recessed portion of the star chamber behind the locking lugs, the tool body (all versions) can be pushed forward. The tool body 100 pushes forward to abut the forward curve of the ejection port of the upper receiver outer wall and the locking lugs. A forward tapered surface of the tool body may engage with the interior of the upper receiver to align the through hole of the tool body with a longitudinal axis of the star chamber. The tool bodies 600, 1100 move forward until the keys 603, 1103 respectively seat into the charging handle notch of the upper receiver. When any of the tool bodies are so moved forwarded and fully seated into the upper receiver, the rod 211 and scraper tool shaft 501 are forced by the tool body to move towards the center of the through hole and both are now substantially in alignment with the through hole axis. Once so aligned with the through hole axis, the T-handle can be rotated to rotate rod 211 to move the scraper 503 through the full circular path to scrape and clean out the recessed portion of the star chamber. Disassembly to remove the tool is accomplished by the same steps in reverse.

The tool body 100 includes an about flat or rectangular shape and is shaped and sized to fit (slide sideways) into the ejection port of an upper receiver. The tool bodies 600, 1100, are typically about cylindrically shaped and are shaped and sized to slide into a rear opening of the upper receiver. A key at about one end of the tool body (600, 1100) can slide into the charge handle notch when the tool body is fully engaged into the upper receiver.

Figure 22:
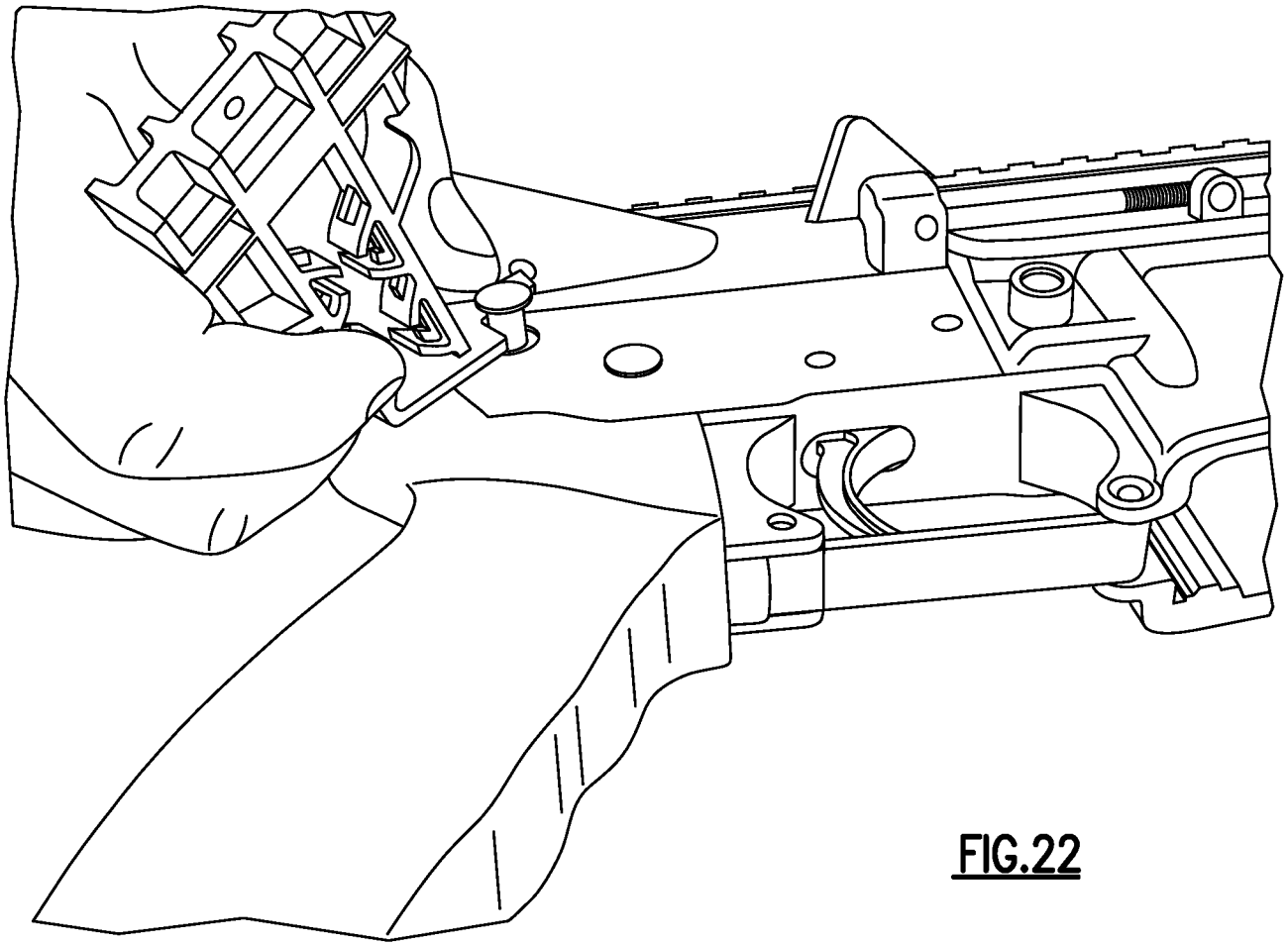
FIG. 22 is a drawing showing the pry tool of a lower version tool being used to remove the rear pin to release the AR upper receiver.

FIG. 22 is a drawing showing the pry tool 105 of a lower version tool 100 being used to remove the rear pin to release the AR upper receiver so that the upper receiver and the lower are on a pivot.

Figure 23:
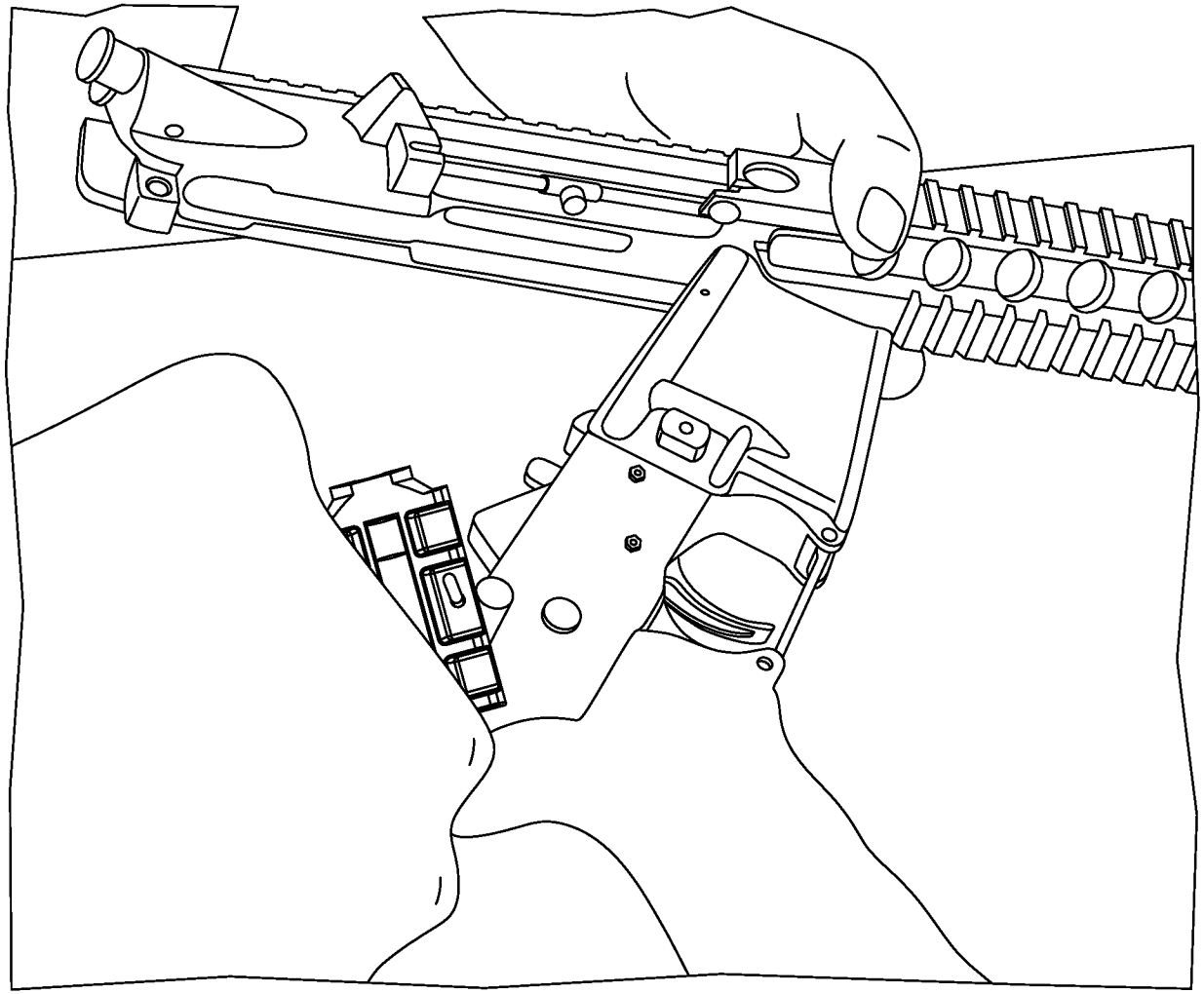
FIG. 23 is a drawing showing the upper receiver and the lower pivoted apart following removal of the rear pin.

FIG. 23 is a drawing showing the upper receiver and the lower pivoted apart following removal of the rear pin.

Figure 24:
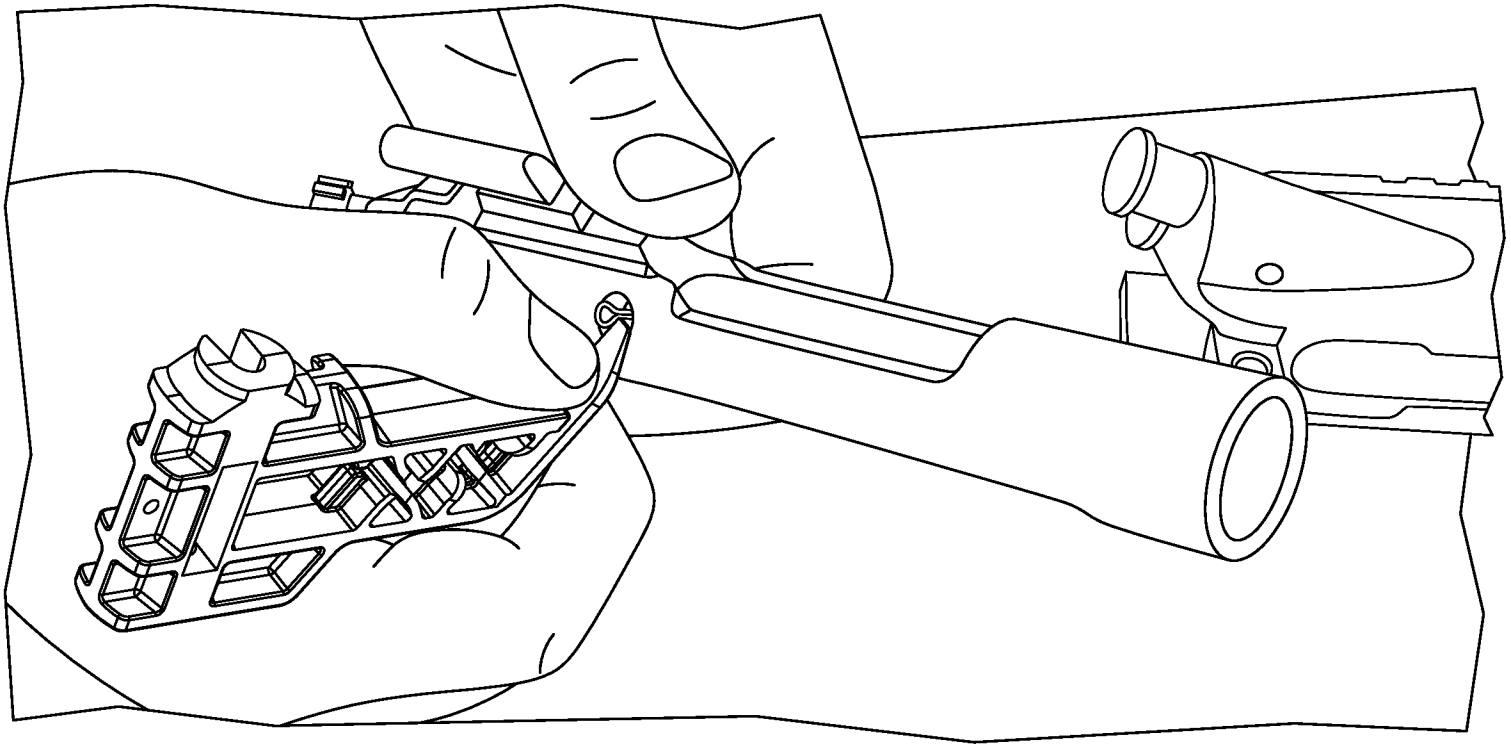
FIG. 24 is a drawing showing the pry tool of a lower version tool being used to remove the firing pin retainer pin from the AR bolt carrier group.

FIG. 24 is a drawing showing the pry tool 105 of a lower version tool 100 being used to remove the firing pin retainer pin from the AR bolt carrier group.

Figure 25:
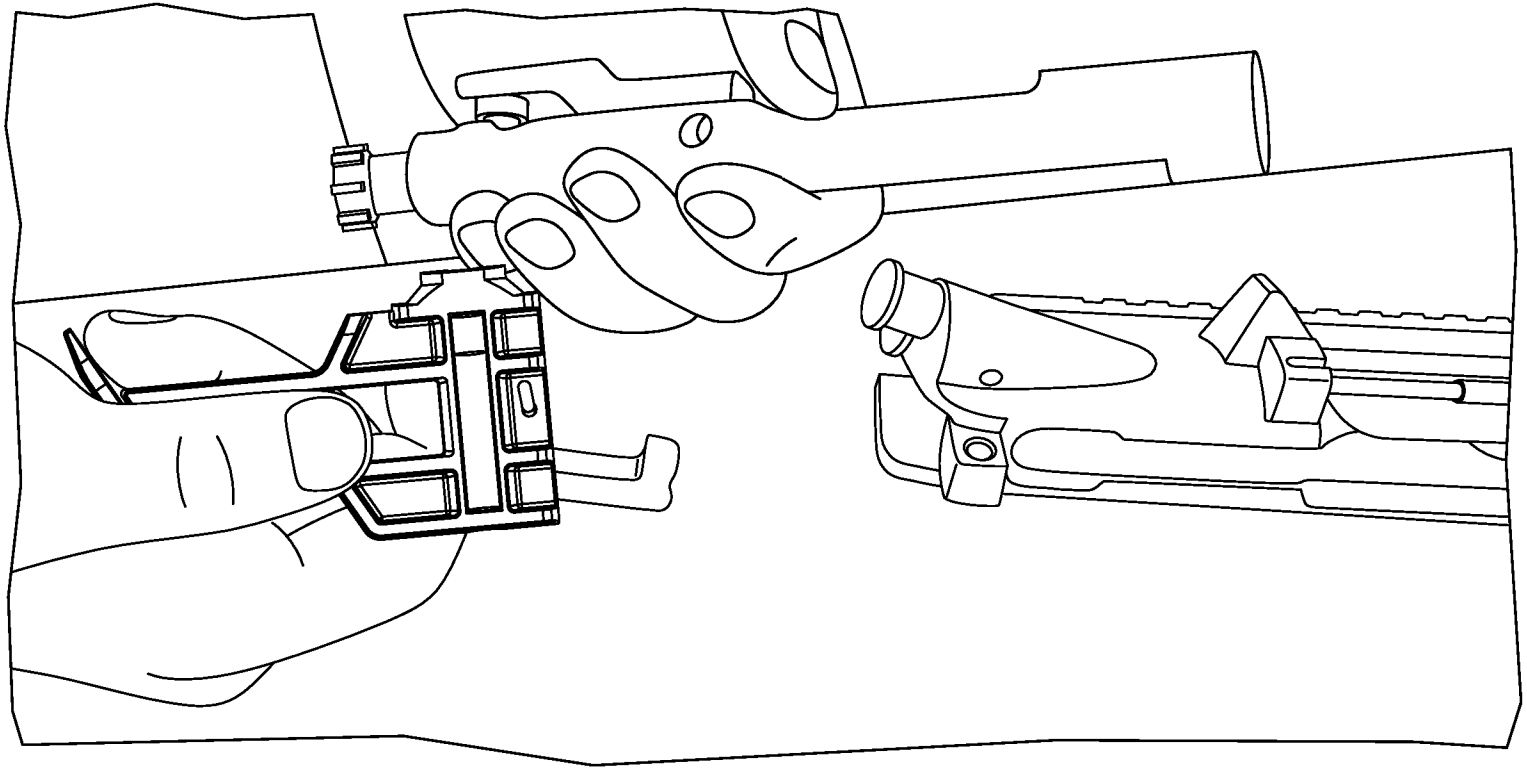
FIG. 25 is a drawing showing the lower version tool, the AR bolt carrier group, and the upper receiver.

FIG. 25 is a drawing showing the lower version tool 100, the AR bolt carrier group, and the upper receiver. The firing pin retainer pin has been placed in hole 277 (FIG. 2E) for safe storage during cleaning.

Figure 26:
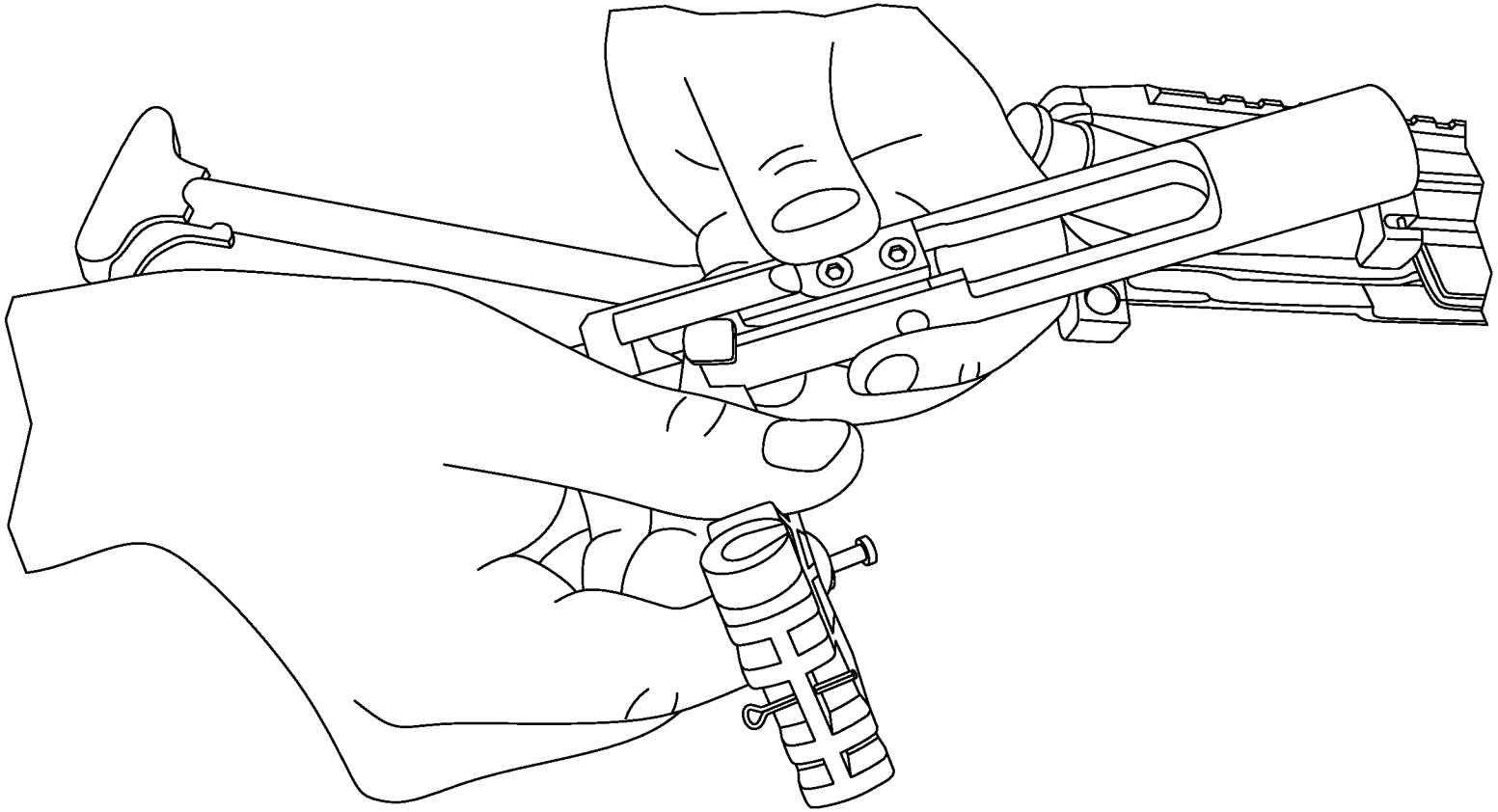
FIG. 26 is a drawing showing the pry tool of a lower version tool being used to remove the cam pin from the AR bolt carrier group to release the AR bolt.

FIG. 26 is a drawing showing the pry tool 105 of a lower version tool 100 being used to remove the cam pin from the AR bolt carrier group to release the AR bolt.

Figure 27:
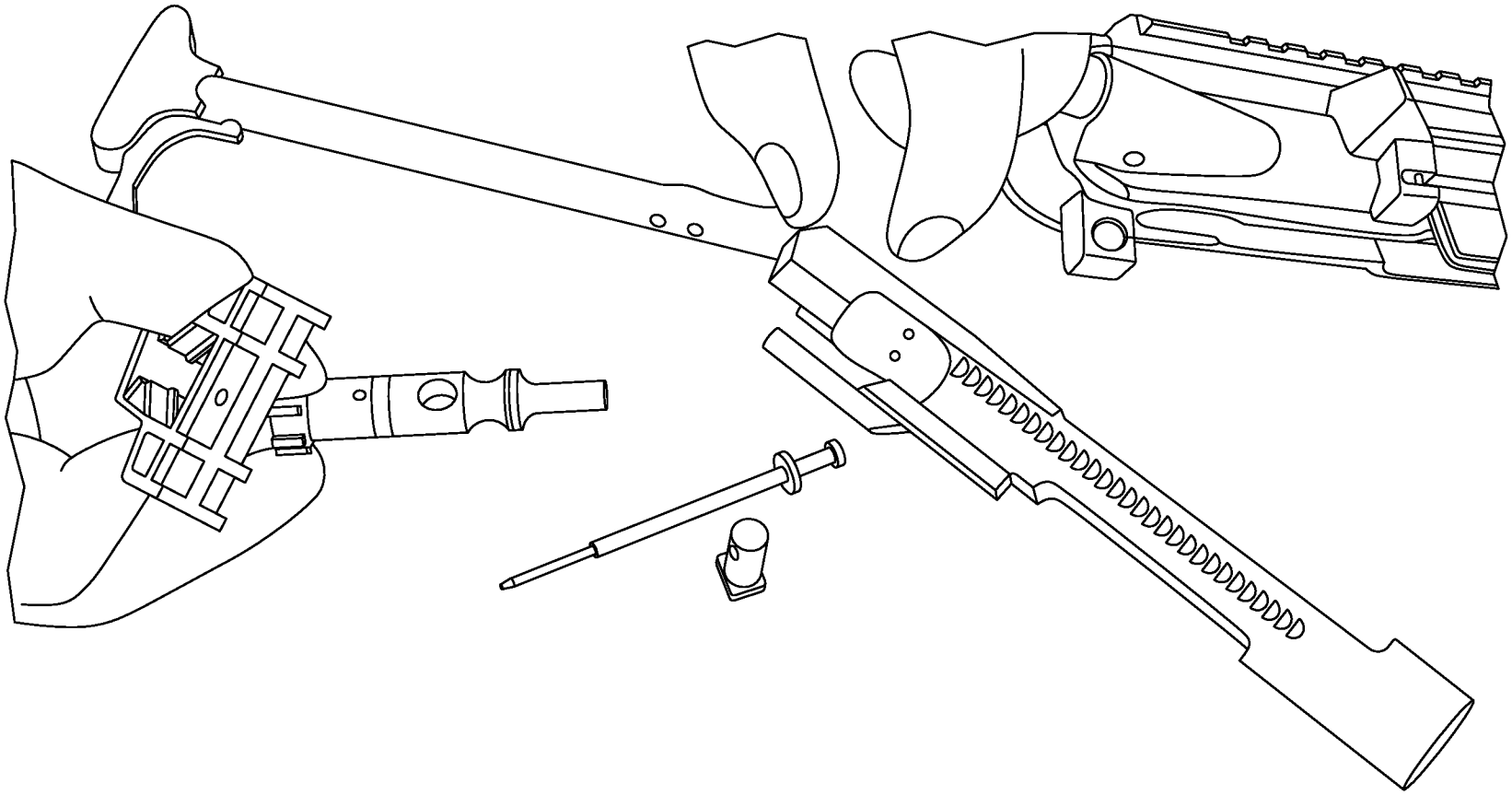
FIG. 27 is a drawing showing the lower version tool, the cam pin, the firing pin, the AR bolt, and the bolt carrier, charge handle, and upper receiver.

FIG. 27 is a drawing showing the lower version tool 100, the cam pin, the firing pin, the AR bolt, and the bolt carrier, charge handle, and upper receiver.

Figure 28:
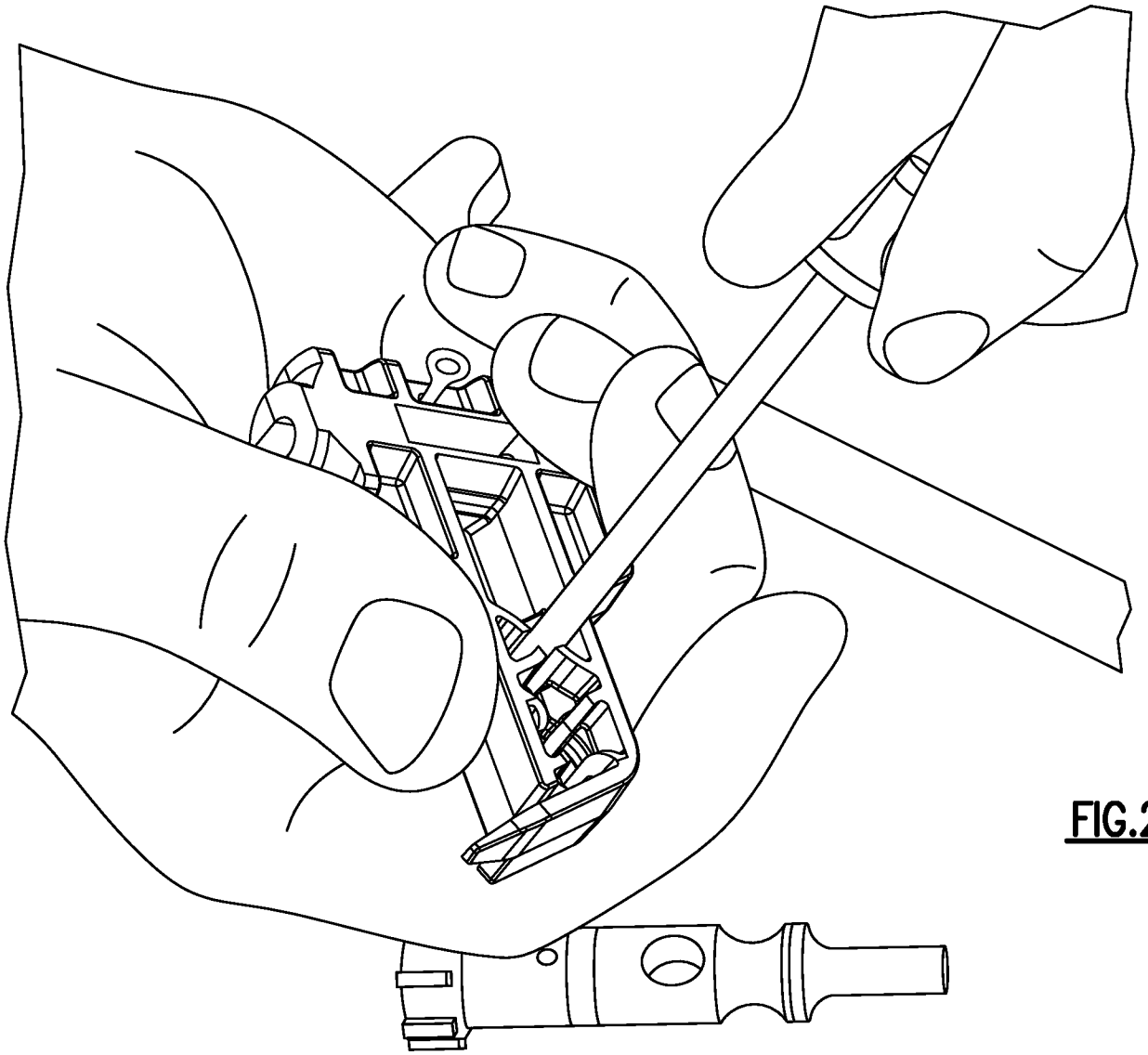
FIG. 28 is a drawing showing the end of the firing pin being cleaned by rotating the firing pin in the smaller scraper tool with scrapers of the lower version tool.

FIG. 28 is a drawing showing the end of the firing pin being cleaned by rotating the firing pin in the smaller scraper tool 115 with scrapers 117 of the lower version tool 100.

Figure 29:
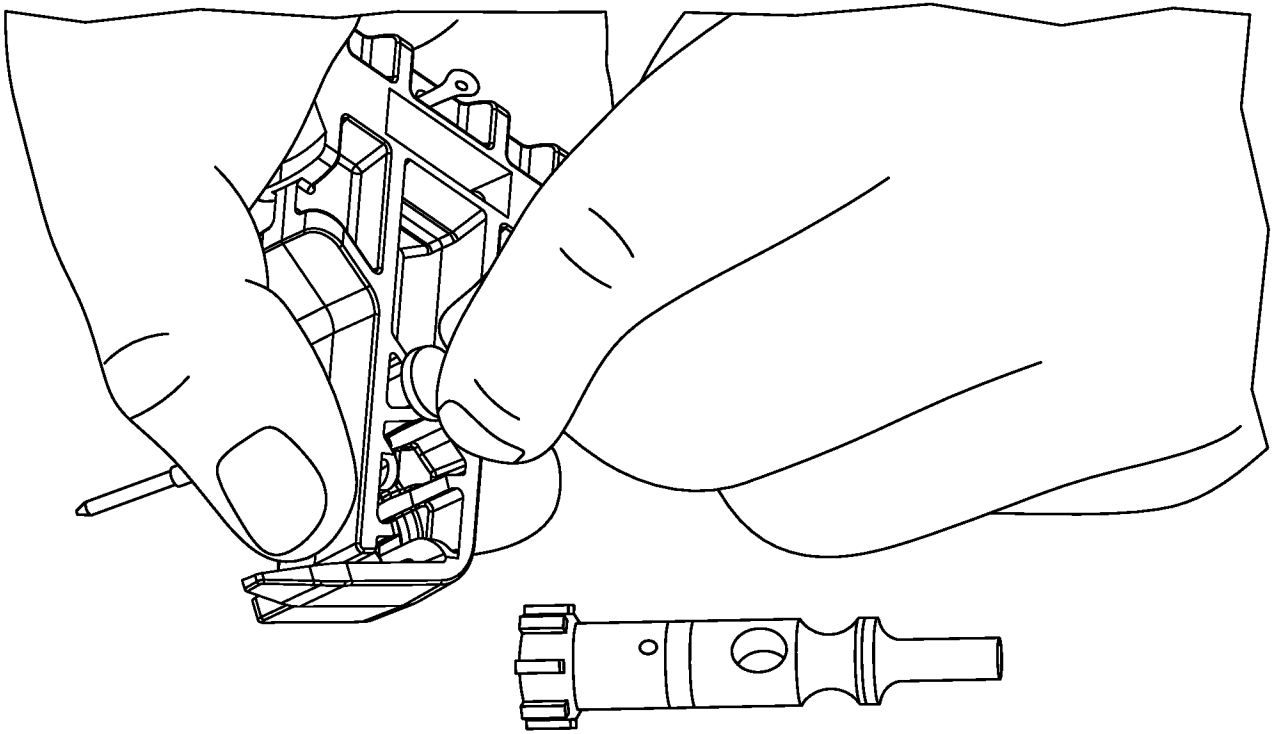
FIG. 29 is another drawing showing the end of the firing pin being cleaned by rotating the firing pin in the scraper tool with scrapers of the lower version tool.

FIG. 29 is another drawing showing the end of the firing pin being cleaned by rotating the firing pin in the smaller scraper tool 115 with scrapers 117 of the lower version tool 100 while pressing with the thumb on lever 161 to increase the force of the scraping edges of scrapers 117 against to surface of the firing pin.

Figure 30:
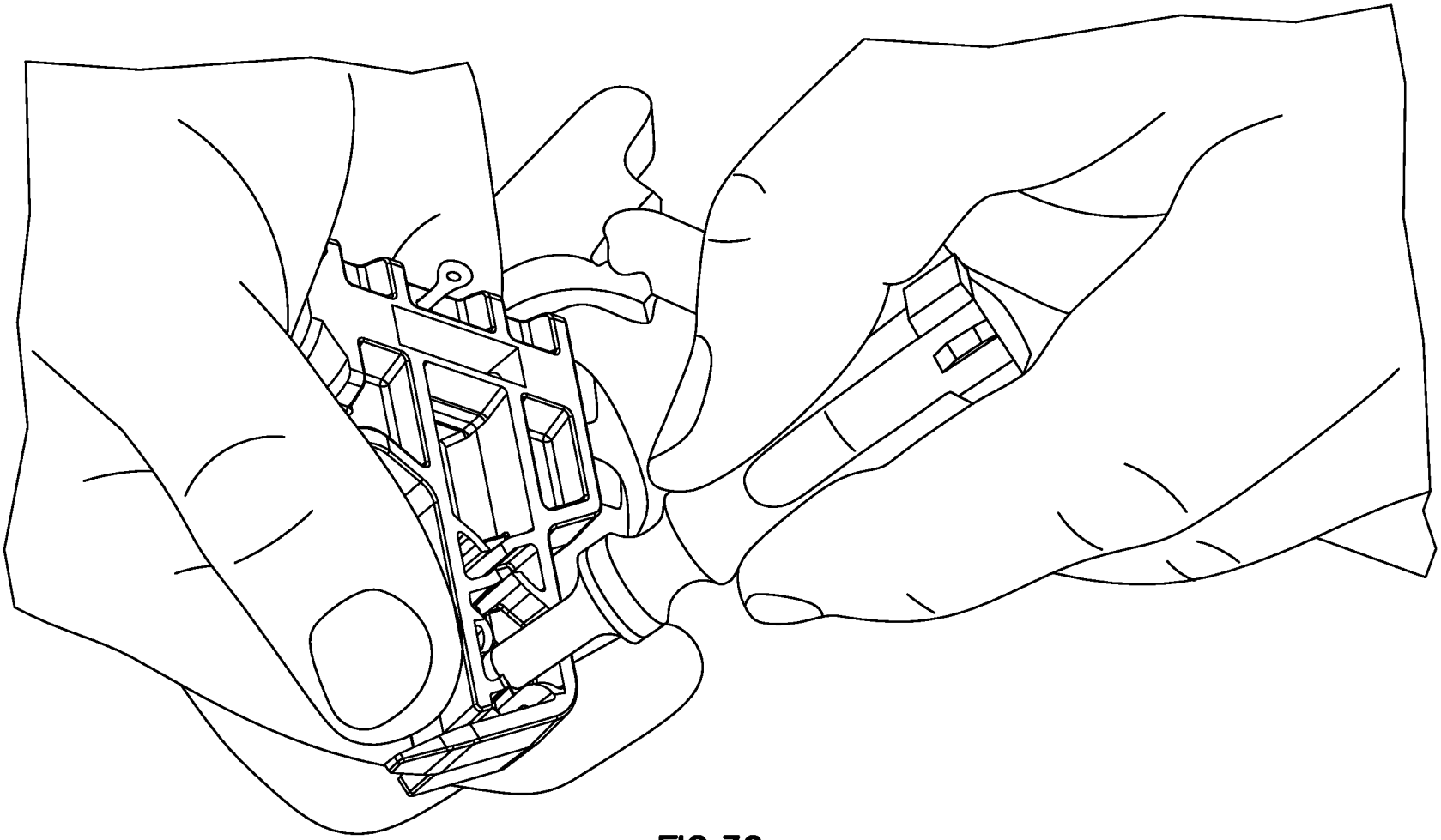
FIG. 30 is a drawing showing the cylindrical shaft of the bolt being cleaned by rotating the bolt in the scraper tool with scrapers of the lower version tool while pressing with the thumb on lever to increase the force of the scraping edges of scrapers against to surface of the bolt.

FIG. 30 is a drawing showing the cylindrical shaft of the bolt being cleaned by rotating the bolt in the scraper tool 111 with scrapers 113 of the lower version tool 100 while pressing with the thumb on lever 161 to increase the force of the scraping edges of scrapers 113 against to surface of the bolt.

Figure 31:
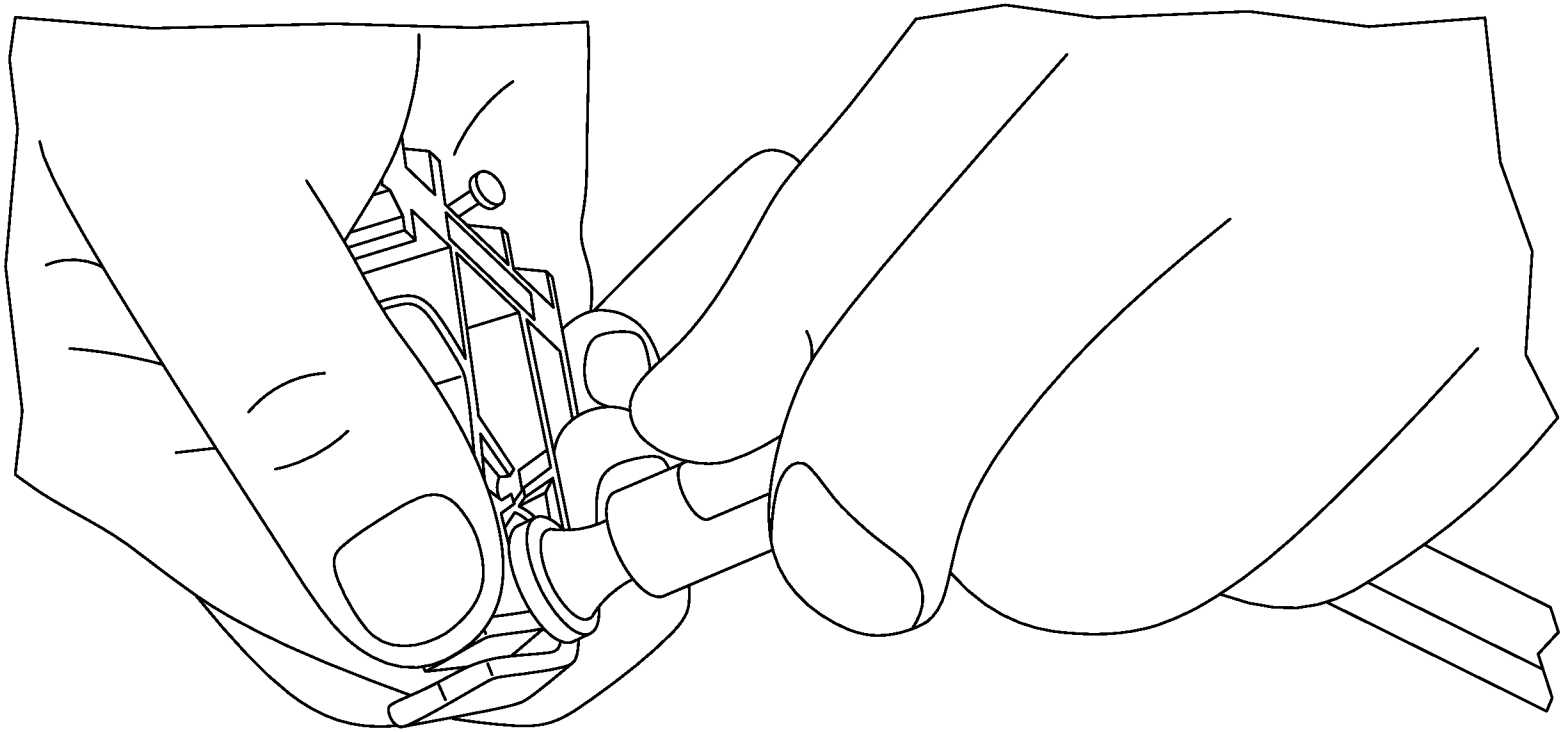
FIG. 31 is a drawing showing the curved face of the bolt being cleaned by rotating the bolt in the scraper tool with scrapers.

FIG. 31 is a drawing showing the curved face of the bolt being cleaned by rotating the bolt in the scraper tool 111 with scrapers 113 with curved portions 173 of the lower version tool 100 while pressing with the thumb on lever 161 to increase the force of the scraping edges of scrapers 113 against to surface of the bolt.

Figure 32:
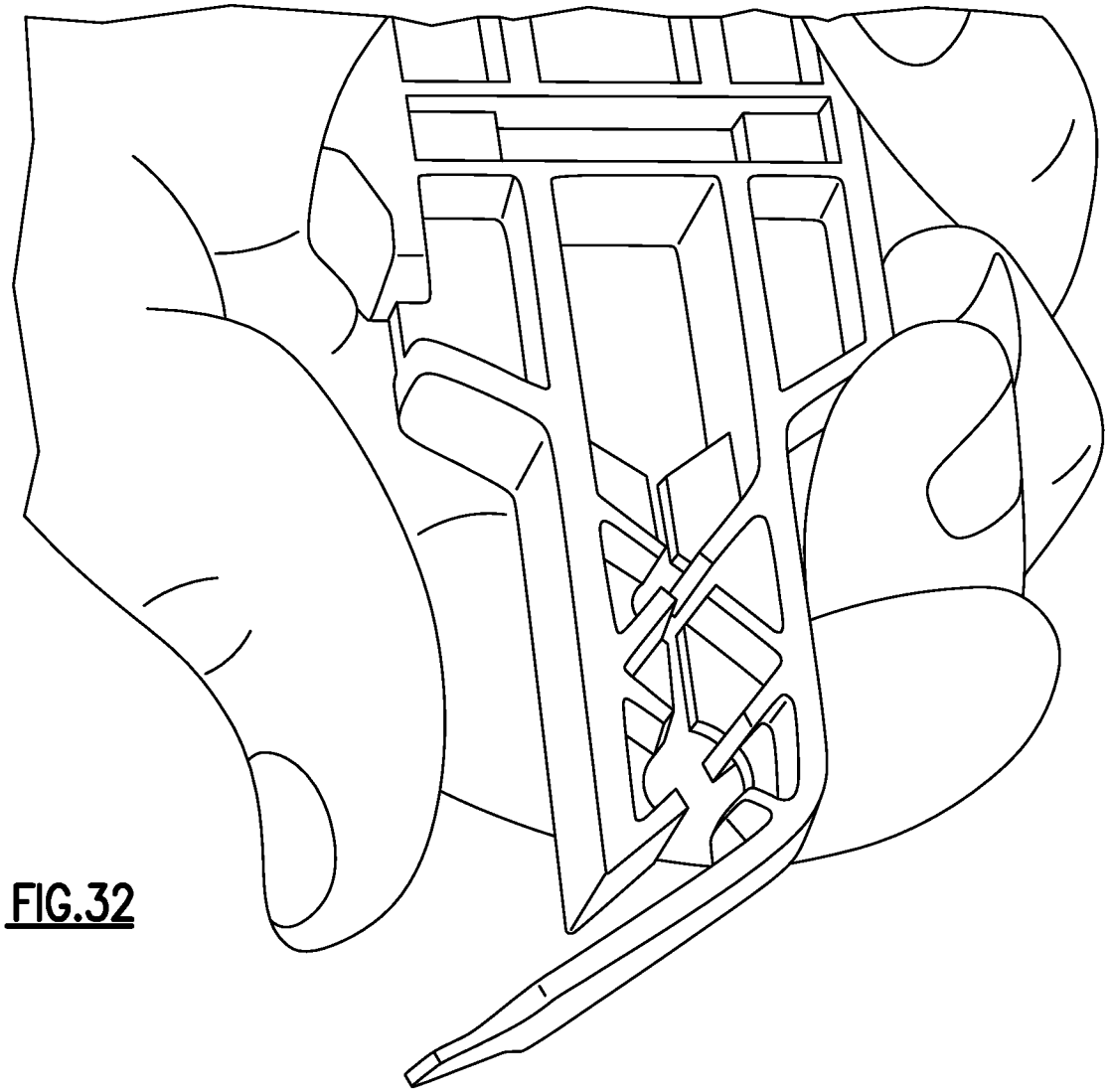
FIG. 32 is a drawing showing one way to hold the lower version tool to be able to push lever with a thumb.

FIG. 32 is a drawing showing one way to hold the lower version tool 100 to be able to push lever 161 with a thumb.

Figure 33:
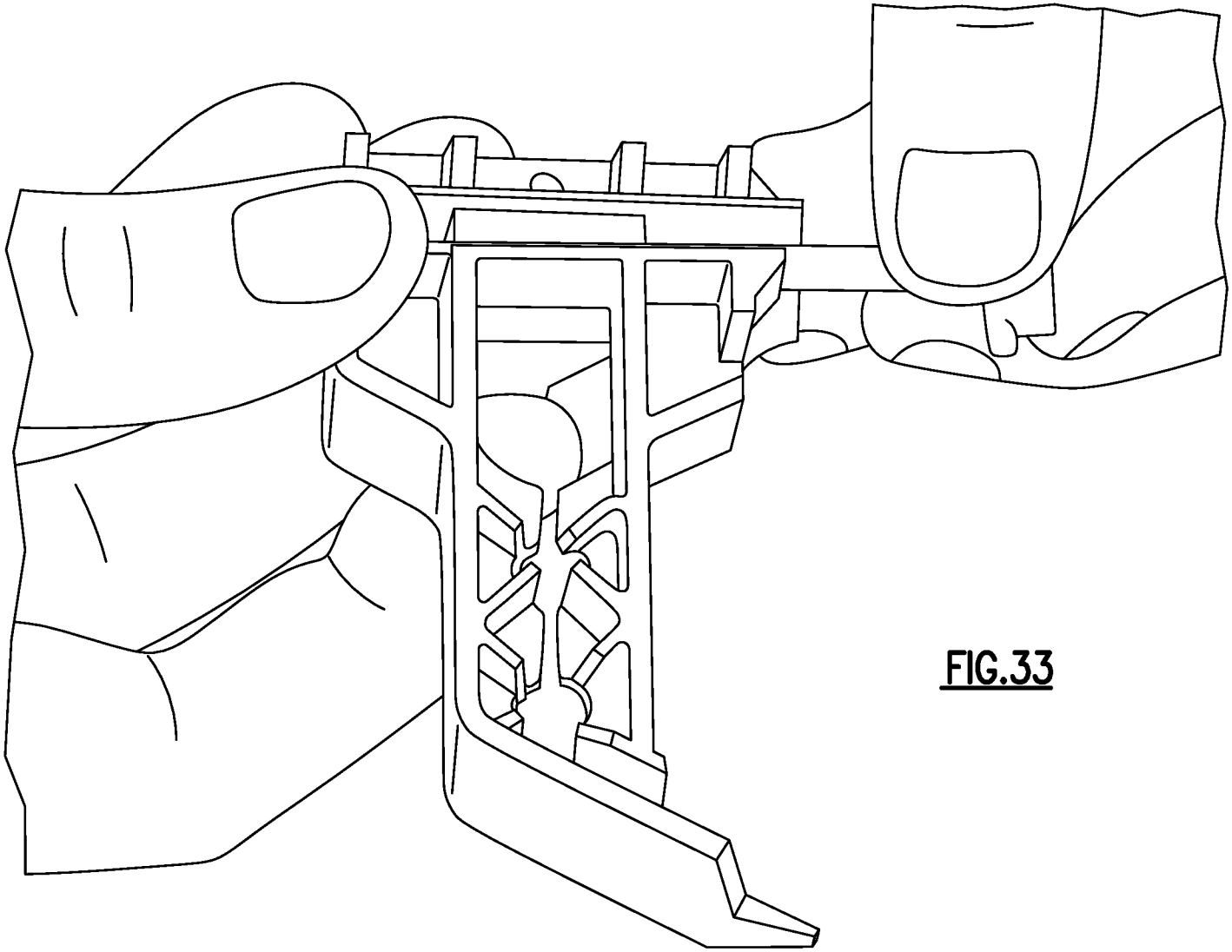
FIG. 33 is a drawing showing the lower version tool showing the scraper shaft of scraper tool inserted into the through hole.

FIG. 33 is a drawing showing the lower version tool 100 showing the scraper shaft 501 of scraper tool 500 inserted into the through hole 125.

Figure 34:
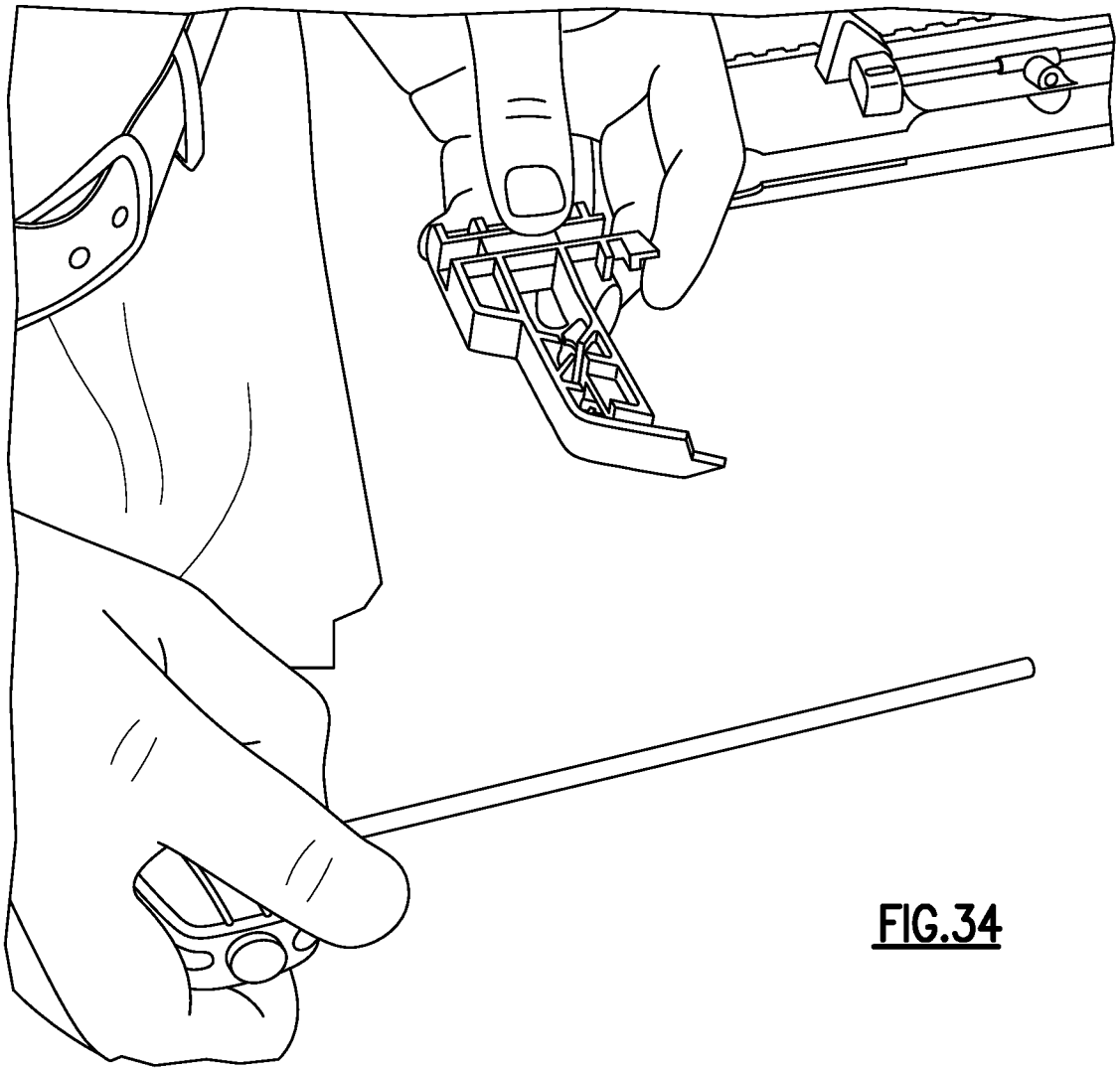
FIG. 34 is a drawing showing the lower version tool showing the scraper shaft of scraper tool inserted into the through hole and the T-handle and shaft being prepared for use.

FIG. 34 is a drawing showing the lower version tool 100 showing the scraper shaft 501 of scraper tool 500 inserted into the through hole 125 and the T-handle 200 and shaft 211 being prepared for use.

Figure 35:
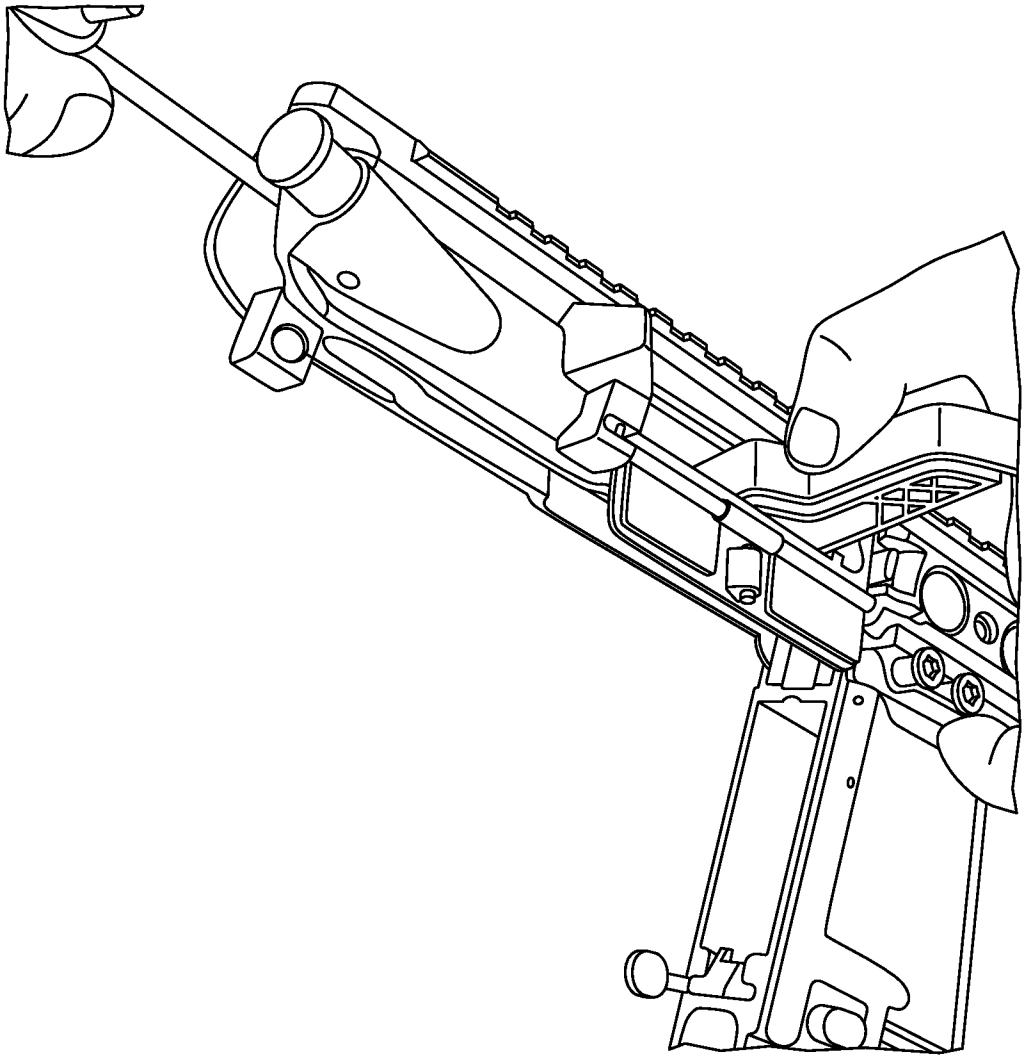
FIG. 35 is a drawing showing the lower version tool and scraper tool inserted into the ejection port of an AR upper, followed by insertion of the rod into the rear opening of the upper receiver being cleaned.

FIG. 35 is a drawing showing the lower version tool 100 and scraper tool 500 inserted into the ejection port of an AR upper, followed by insertion of the rod 211 into the rear opening of the upper receiver being cleaned.

Figure 36:
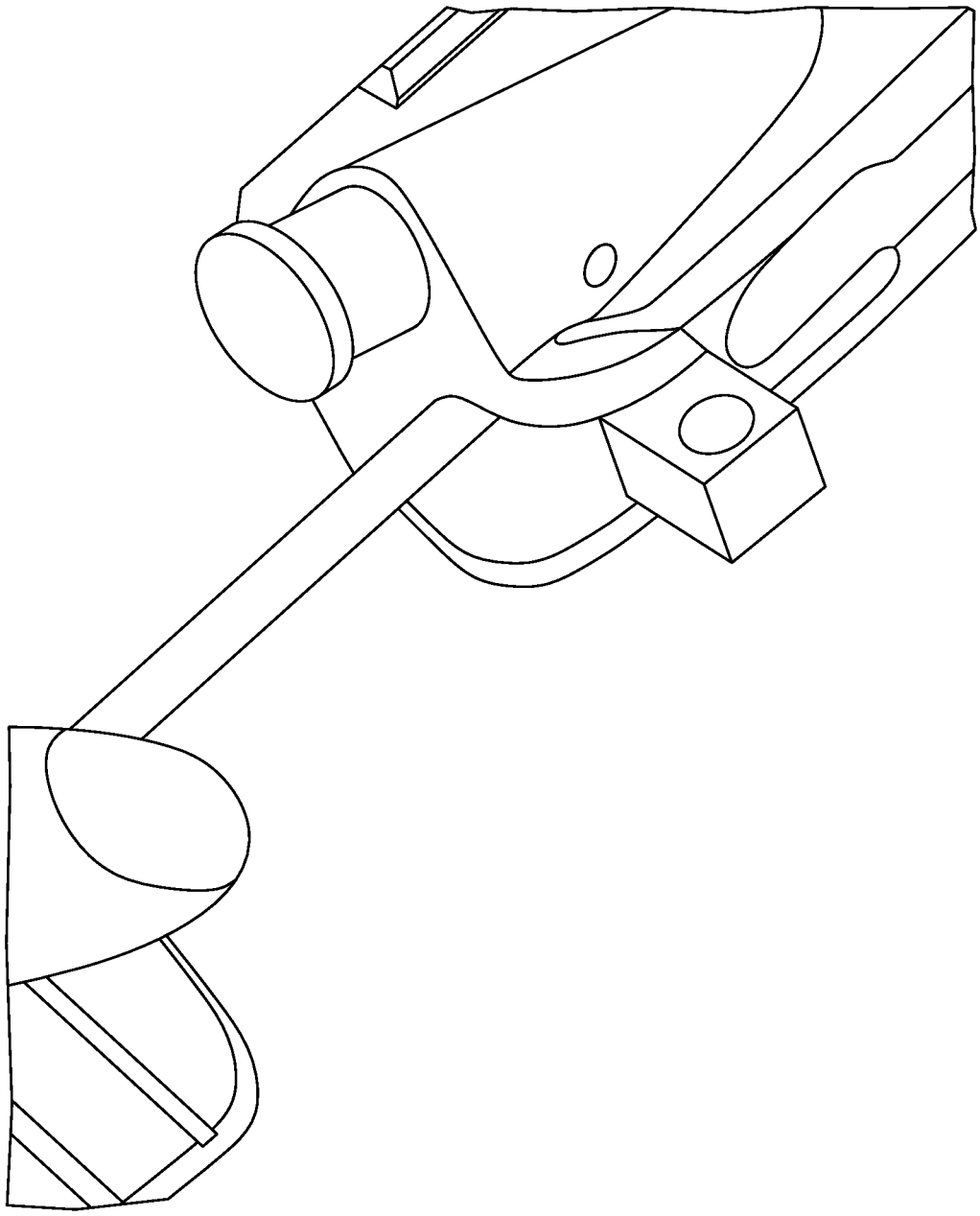
FIG. 36 is a drawing showing the lower version tool and scraper tool being rotated by T-handle.

FIG. 36 is a drawing showing the lower version tool 100 and scraper tool 500 being rotated by T-handle 200.

Figure 37:
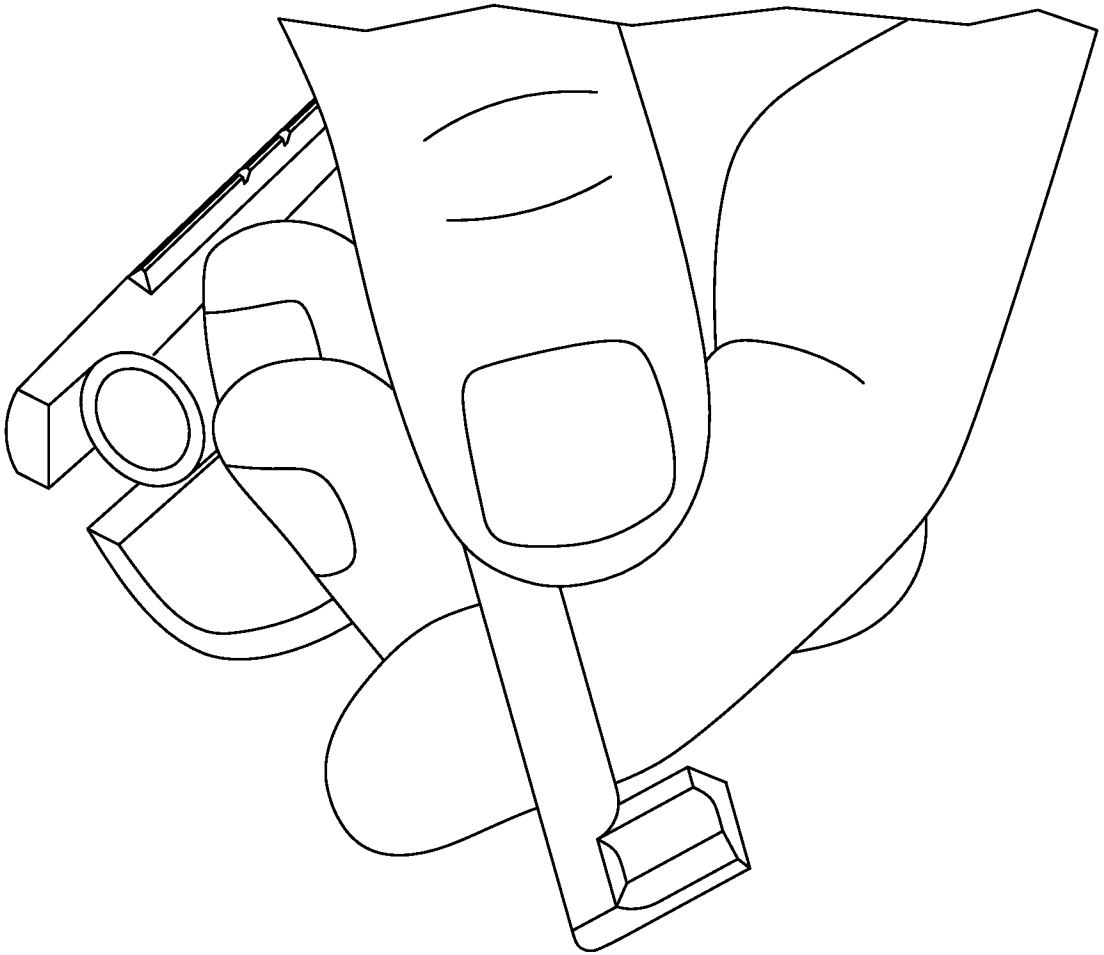
FIG. 37 is a drawing showing the material removed from the upper by the scraper tool during the step of FIG. 36.

FIG. 37 is a drawing showing the material removed from the upper by the scraper tool 500 during the step of FIG. 36.

Figure 38:
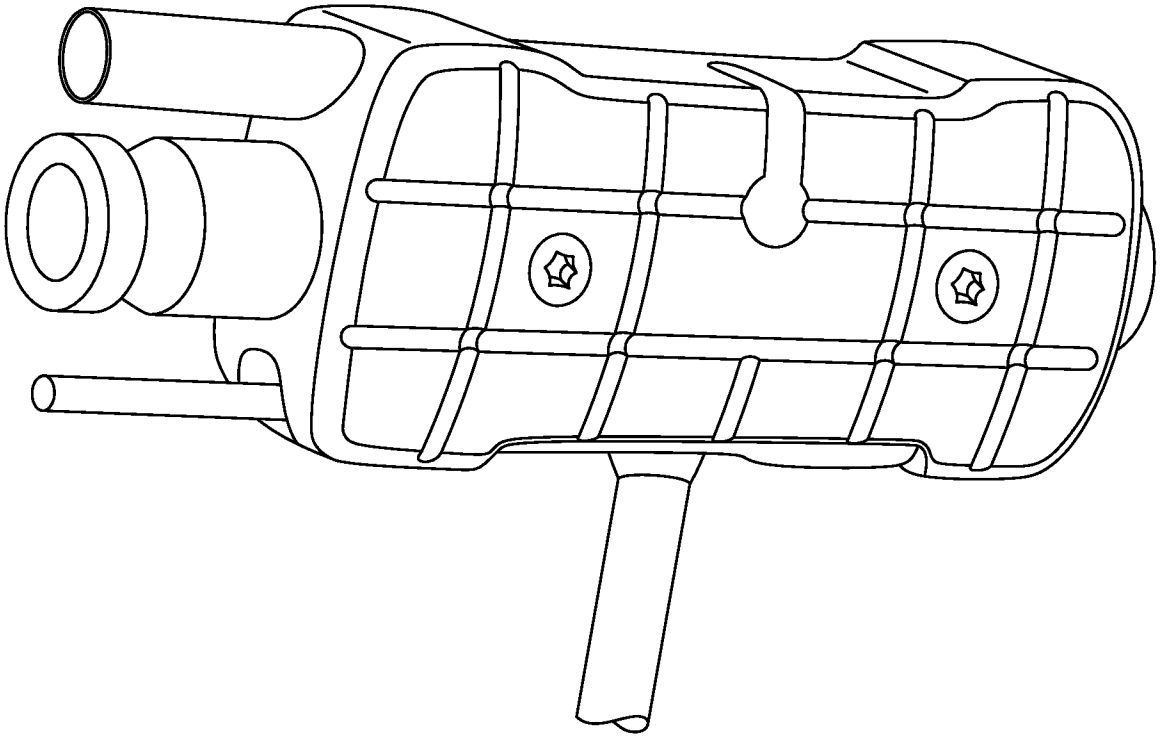

FIG. 38 is a close-up view of an exemplary T-Handle 200. Rod 211 can be affixed to T-handle 200 by any suitable means, including, for example, threadingly coupled, press fit coupled, slot and tab coupled, bayonet coupled, etc. A similar T-handle which can carry other sockets for bits and bits was described in U.S. Pat. No. 9,964,378 which is assigned to the OTIS Patent Trust. The '378 patent is hereby incorporated by reference in its entirety for all purposes.

Figure 39:
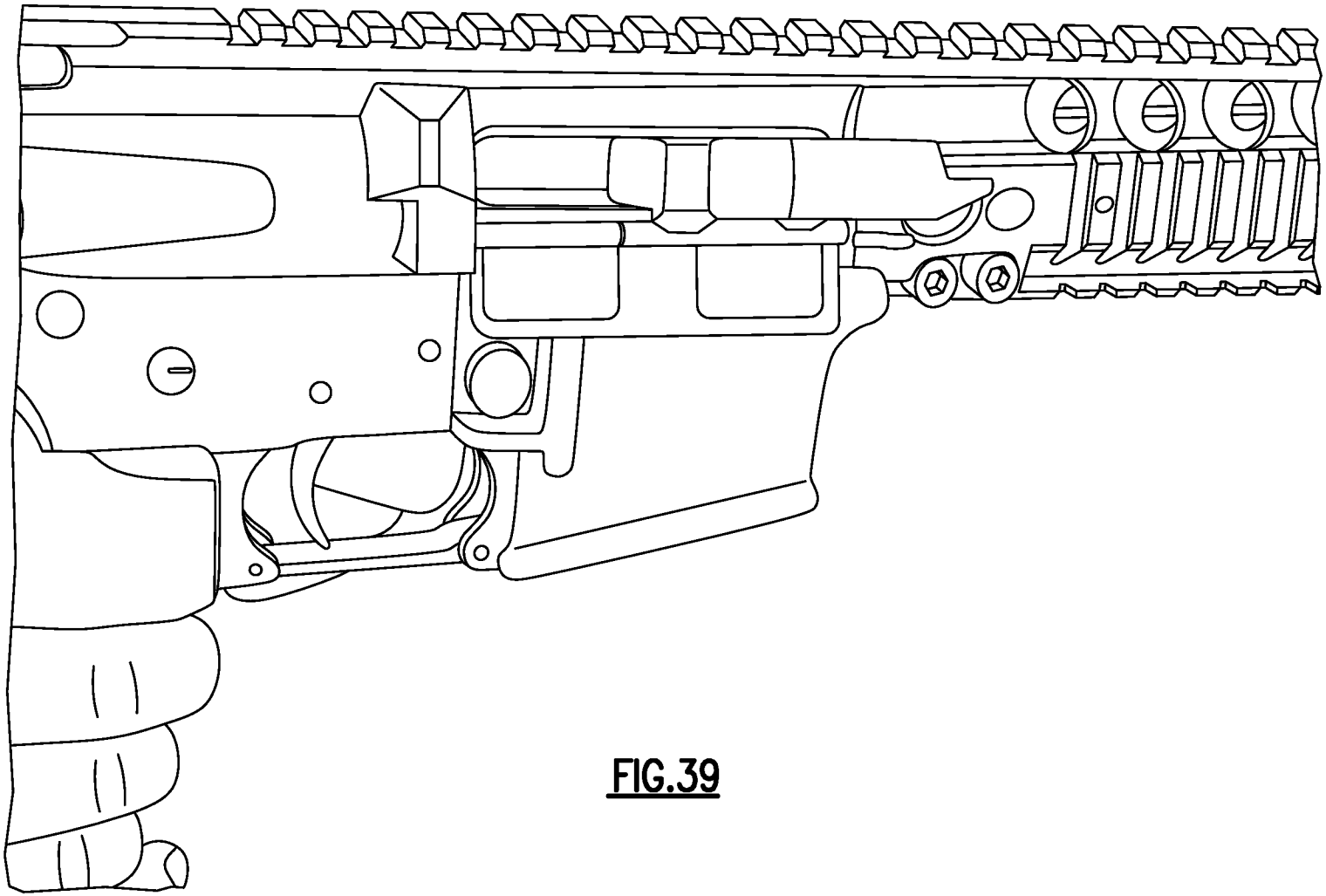

FIG. 39 is a drawing showing the lower version tool 100 inserted into an assembled AR as a safety block.

Figure 40:
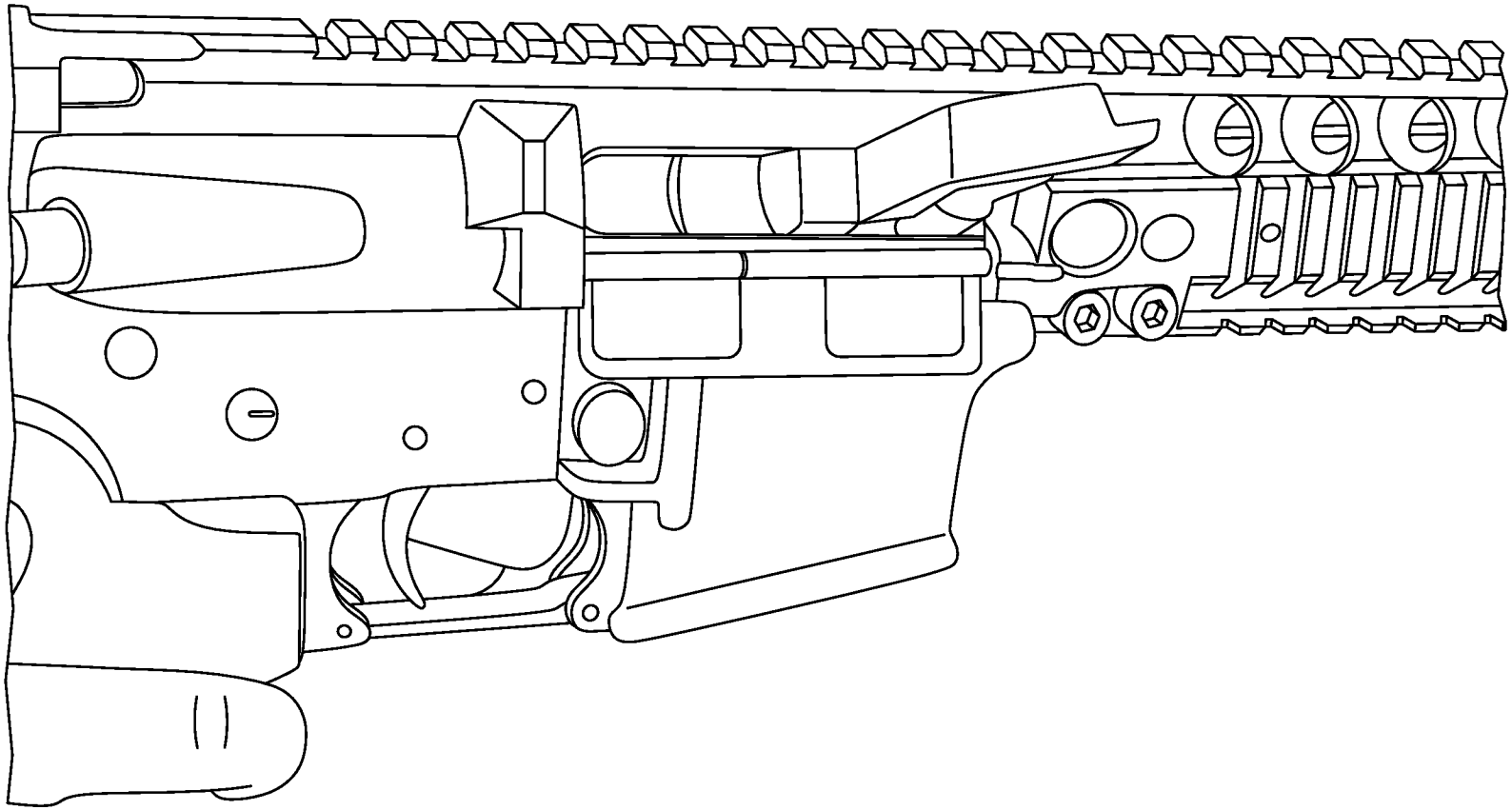

FIG. 40 is another drawing showing the lower version tool 100 blocking the bolt carrier group.

The tools described hereinabove can be made from any suitable metals or plastics and combination thereof. Typically, they are made from a plastic, such as, for example, a thermoplastic.

Any suitable ribs can be used as shown in the exemplary drawings to strengthen the parts.

Through holes and openings can be of any suitable shapes and sizes. For example, there can be rectangular, circular, three wall openings and any suitable combinations thereof. Through hole channels can be round, part round, half round, square, rectangular, and combinations thereof. There can be several successive or cascaded series of openings, channels, cylindrical paths, etc. and combinations thereof to create the slidable and rotatable through hole for the rod and shaft of the scraper tool.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A rifle star chamber cleaning tool body comprising:

a through hole disposed along a rifle star chamber tool body long axis, at least one end of the through hole comprising a groove or slot opening extending into a groove or slot shape hole of an end face cross section in a plane about perpendicular to said rifle star chamber tool body long axis, said through hole adapted to slidingly and rotatingly accept a rod;

wherein said rifle star chamber cleaning tool body is shaped to slide at least in part into an internal cavity of an upper receiver of a rifle; and wherein by way of said groove or slot, during insertion of a scraper tool having a radial extension into a star chamber defined by a plurality of radial protrusions into said internal cavity, said rod has a yaw angle with respect to said tool body long axis to allow an insertion of said scraper tool into and through an inner diameter of a plurality of locking lugs of a star chamber of a rifle.

2. The rifle star chamber cleaning tool body of claim 1, wherein said groove or slot allows a rod to slide through said through hole where said rod comprises a yaw angle with respect to said tool body long axis.

3. The rifle star chamber cleaning tool body of claim 1, wherein said groove or slot comprises a tapered groove or a tapered slot.

4. The rifle star chamber cleaning tool body of claim 1, further comprising at least one scraper tool.

5. The rifle star chamber cleaning tool body of claim 1, further comprising a pry tool.

6. The rifle star chamber cleaning tool body of claim 1, wherein said rifle star chamber cleaning tool body comprises an about flat or rectangular body sized to fit into a shell ejection port of an upper receiver.

7. The rifle star chamber cleaning tool body of claim 1, further comprising a key shaped to fit into a charging handle notch of an upper receiver to be cleaned.

8. The rifle star chamber cleaning tool body of claim 1, wherein both ends of the through hole comprise a groove or slot opening extending into a groove or slot shape hole of an end face cross section in a plane about perpendicular to said rifle star chamber tool body long axis.

9. The rifle star chamber cleaning tool body of claim 8, wherein said groove or slot shape hole of an end face cross section in a plane about perpendicular to said rifle star chamber tool body long axis disposed at a second end of said rifle star chamber cleaning tool body is rotated about 180° in said plane about perpendicular to said rifle star chamber tool body long axis, with respect to said groove or slot shape hole of an end face cross section in a plane about perpendicular to said rifle star chamber tool body long axis disposed at a first end of said rifle star chamber cleaning tool body.

10. The rifle star chamber cleaning tool body of claim 8, wherein said groove or slot shape hole of an end face cross section in a plane about perpendicular to said rifle star chamber tool body long axis disposed at a second end of said rifle star chamber cleaning tool body is disposed in about a same radial direction in said plane about perpendicular to said rifle star chamber tool body long axis, with respect to said groove or slot shape hole of an end face cross section in a plane about perpendicular to said rifle star chamber tool body long axis disposed at a first end of said rifle star chamber cleaning tool body.

11. A method to clean a star chamber of an upper receiver of a rifle comprising:

providing a rifle star chamber cleaning tool body, and rod, a T-handle adapted to be coupled to a first end of said rod, and a scraper tool adapted to be coupled to a second end of said rod;

placing a rifle star chamber cleaning tool body at least part way and not fully engaged into an upper receiver of the rifle;

aligning a rod coupled to a scraper tool shaft of a scraper tool at a yaw angle with respect to a long axis of said rifle star chamber cleaning tool body within a slot or groove opening about an end of said rifle star chamber cleaning tool body so that a scraper of the scraper tool can pass through in an inner diameter opening of the star chamber and placed behind a plurality of locking lugs of the star chamber;

fully engaging said rifle star chamber cleaning tool body into the upper receiver to cause the scraper tool shaft of the scraper tool to substantially center along the long axis of said rifle star chamber cleaning tool body; and rotating the rod to cause the scraper to rotate within the star chamber to clean the star chamber behind the locking lugs.

12. The method of claim 11, wherein the step of fully engaging, comprises pushing a flat or rectangular rifle star chamber cleaning tool body to an edge of an ejection port of the upper receiver closest to the star chamber.

13. The method of claim 11, wherein the step of fully engaging, comprises pushing a rifle star chamber cleaning tool body into an upper receiver to fully engage a key into a charge handle notch.

14. A rifle star chamber cleaning tool comprising:

a rifle star chamber cleaning tool body;

a rod having a rod longitudinal axis and a first rod end and a second rod end;

a T-Handle coupled to said first rod end;

a scraper tool removeably coupled to said second rod end, said scraping tool having a radial extension and a radial scraping surface;

a through hole disposed in about a center of said rifle star chamber cleaning tool body along a tool body long axis and at least one end of the through hole comprising a groove or slot opening extending into a groove or slot shape hole of an end face cross section in a plane about perpendicular to said rifle star chamber tool body long axis, said rod rotatingly and slidingly disposed in said through hole;

wherein said rifle cleaning tool body is shaped to slide at least in part into an upper receiver of a rifle; and wherein by way of said groove or slot, during insertion of said scraper tool into a star chamber, said rod has a yaw angle with respect to said tool body long axis to allow an insertion of said scraper tool into and through an opening defined between a plurality of locking lugs of a star chamber of a rifle.

15. A method to clean a star chamber of an upper receiver of a rifle comprising:

providing a rifle star chamber cleaning tool comprising a rifle star chamber cleaning tool body, a rod having a rod longitudinal axis and a first rod end and a second rod end, a T-Handle coupled to said first rod end, a scraper tool having a scraper blade, said scraper tool removeably coupled to said second rod end, a through hole disposed in about a center of said rifle star chamber cleaning tool body along a tool body long axis and at least one end of the through hole comprising a groove or slot, said rod rotatingly and slidingly disposed in said through hole;

sliding said rifle cleaning tool body at least in part into an upper receiver of a rifle;

advancing the scraper tool into a recessed area of the star chamber behind a plurality of locking lugs;

advancing the rifle star chamber cleaning tool body toward the star chamber to place the rod in a coaxial position with the through hole in the cleaning tool body, and with the rod in a coaxial position in the through hole; and rotating the blade of the scraper tool in close relationship to a wall of the recessed area for removal of dirt and residue accumulated from firing the rifle.

16. A rifle star chamber cleaning tool body comprising:

a through hole disposed along a rifle star chamber tool body long axis, at least one end of the through hole comprising a groove or slot opening extending into a groove or slot shape hole of an end face cross section in a plane about perpendicular to said rifle star chamber tool body long axis, said through hole adapted to slidingly and rotatingly accept a rod;

wherein said rifle star chamber cleaning tool body comprises a first end having a diameter less than an internal cavity of an upper receiver of a rifle, said rifle star chamber cleaning tool body shaped to slide at least in part into said internal cavity of the upper receiver of a rifle; and wherein by way of said groove or slot, during insertion of a scraper tool having a radial extension into a star chamber defined by a plurality of radial protrusions into said internal cavity, said rod has a yaw angle with respect to said tool body long axis to allow an insertion of said scraper tool into and through an inner diameter of a plurality of locking lugs of a star chamber of a rifle.

17. A rifle star chamber cleaning tool comprising:

a rifle star chamber cleaning tool body comprising a first end having a diameter less than an internal cavity of an upper receiver of a rifle, said rifle star chamber cleaning tool body shaped to slide at least in part into said internal cavity of the an upper receiver of a rifle;

a rod having a rod longitudinal axis and a first rod end and a second rod end;

a T-Handle coupled to said first rod end;

a rigid scraper blade removeably coupled to said second rod end;

a through hole disposed in about a center of said rifle star chamber cleaning tool body along a tool body long axis and at least one end of the through hole comprising a groove or slot, said rod rotatingly and slidingly disposed in said through hole; and wherein by way of said groove or slot, during insertion of said scraper tool into a star chamber, said rod has a yaw angle with respect to said tool body long axis to allow an insertion of said rigid scraper blade into and through a plurality of locking lugs into a star chamber of a rifle.

* * * * *